US008989354B2

(12) United States Patent
Davis et al.

(10) Patent No.: US 8,989,354 B2
(45) Date of Patent: Mar. 24, 2015

(54) CARBON COMPOSITE SUPPORT STRUCTURE

(75) Inventors: Robert C. Davis, Provo, UT (US); Jason Mathew Lund, Provo, UT (US); Andrew L. Davis, Provo, UT (US); Steven D. Liddiard, Springville, UT (US); Mike Zappe, Lehi, UT (US); Charles R. Jensen, American Fork, UT (US)

(73) Assignees: Brigham Young University, Provo, UT (US); Moxtek, Inc., Orem, UT (US)

( * ) Notice: Subject to any disclaimer, the term of this patent is extended or adjusted under 35 U.S.C. 154(b) by 424 days.

(21) Appl. No.: 13/453,066

(22) Filed: Apr. 23, 2012

(65) Prior Publication Data

US 2013/0051535 A1 Feb. 28, 2013

Related U.S. Application Data

(60) Provisional application No. 61/486,547, filed on May 16, 2011, provisional application No. 61/495,616, filed on Jun. 10, 2011, provisional application No. 61/511,793, filed on Jul. 26, 2011.

(51) Int. Cl.
*H01J 35/18* (2006.01)
*H01J 5/18* (2006.01)

(52) U.S. Cl.
CPC ..... *H01J 35/18* (2013.01); *H01J 2223/18* (2013.01); *H01J 2235/183* (2013.01); *H01J 5/18* (2013.01)
USPC ..... 378/161

(58) Field of Classification Search
CPC ..... H01J 5/18; H01J 35/18; H01J 2235/18; H01J 2235/183
USPC ..... 378/161
See application file for complete search history.

(56) References Cited

U.S. PATENT DOCUMENTS

| | | | |
|---|---|---|---|
| 1,276,706 | A | 5/1918 | Snook et al. |
| 1,881,448 | A | 10/1932 | Forde et al. |
| 1,946,288 | A | 2/1934 | Kearsley |
| 2,291,948 | A | 8/1942 | Cassen |
| 2,316,214 | A | 4/1943 | Atlee et al. |
| 2,329,318 | A | 9/1943 | Atlee et al. |

(Continued)

FOREIGN PATENT DOCUMENTS

| | | |
|---|---|---|
| DE | 1030936 | 5/1958 |
| DE | 4430623 | 3/1996 |

(Continued)

OTHER PUBLICATIONS

T. Nakajima et al., "Trial use of carbon-fiber-reinforced plastic as a non-Bragg window material of x-ray transmission," Review of Scientific Instruments 60, 2432 (1989).*

(Continued)

*Primary Examiner* — Allen C. Ho

(57) ABSTRACT

A support structure for x-ray windows including carbon composite ribs, comprising carbon fibers in a matrix. The support structure can comprise a support frame defining a perimeter and an aperture, a plurality of ribs comprising a carbon composite material extending across the aperture of the support frame and carried by the support frame, and openings between the plurality of ribs. A film can be disposed over, carried by, and span the plurality of ribs and disposed over and span the openings.

21 Claims, 11 Drawing Sheets

(56) References Cited

U.S. PATENT DOCUMENTS 2,340,363 A 2/1944 Atlee et al.
2,502,070 A 3/1950 Atlee et al.
2,663,812 A 3/1950 Jamison et al.
2,683,223 A 7/1954 Hosemann
2,952,790 A 9/1960 Steen
3,358,368 A 12/1967 Oess
3,397,337 A 8/1968 Denholm
3,665,236 A 5/1972 Gaines et al.
3,679,927 A 7/1972 Kirkendall
3,691,417 A 9/1972 Gralenski
3,741,797 A 6/1973 Chavasse, Jr. et al.
3,751,701 A 8/1973 Gralenski et al.
3,801,847 A 4/1974 Dietz
3,828,190 A 8/1974 Dahlin et al.
3,873,824 A 3/1975 Bean
3,882,339 A 5/1975 Rate et al.
3,962,583 A 6/1976 Holland et al.
3,970,884 A 7/1976 Golden
4,007,375 A 2/1977 Albert
4,075,526 A 2/1978 Grubis
4,126,788 A * 11/1978 Koontz et al. ..... 378/32
4,160,311 A 7/1979 Ronde et al.
4,163,900 A 8/1979 Warren et al.
4,178,509 A 12/1979 More et al.
4,184,097 A 1/1980 Auge
4,250,127 A 2/1981 Warren et al.
4,368,538 A 1/1983 McCorkle
4,393,127 A 7/1983 Greschner et al.
4,463,257 A 7/1984 Simpkins et al.
4,463,338 A 7/1984 Utner et al.
4,521,902 A 6/1985 Peugeot
4,532,150 A 7/1985 Endo et al.
4,573,186 A 2/1986 Reinhold
4,576,679 A 3/1986 White
4,584,056 A 4/1986 Perret et al.
4,591,756 A 5/1986 Avnery
4,608,326 A 8/1986 Neukermans et al.
4,645,977 A 2/1987 Kurokawa et al.
4,675,525 A 6/1987 Amingual et al.
4,679,219 A 7/1987 Ozaki
4,688,241 A 8/1987 Peugeot
4,696,994 A 9/1987 Nakajima
4,705,540 A 11/1987 Hayes
4,777,642 A 10/1988 Ono
4,797,907 A 1/1989 Anderton
4,818,806 A 4/1989 Kunimune et al.
4,819,260 A 4/1989 Haberrecker
4,862,490 A 8/1989 Karnezos et al.
4,870,671 A 9/1989 Hershyn
4,876,330 A 10/1989 Higashi et al.
4,878,866 A 11/1989 Mori et al.
4,885,055 A 12/1989 Woodbury et al.
4,891,831 A 1/1990 Tanaka et al.
4,933,557 A 6/1990 Perkins
4,939,763 A 7/1990 Pinneo et al.
4,957,773 A 9/1990 Spencer et al.
4,960,486 A 10/1990 Perkins et al.
4,969,173 A 11/1990 Valkonet
4,979,198 A 12/1990 Malcolm et al.
4,979,199 A 12/1990 Cueman et al.
5,010,562 A 4/1991 Hernandez et al.
5,063,324 A 11/1991 Grunwald et al.
5,066,300 A 11/1991 Isaacson et al.
5,077,771 A 12/1991 Skillicorn et al.
5,077,777 A 12/1991 Daly
5,090,046 A 2/1992 Friel
5,105,456 A 4/1992 Rand et al.
5,117,829 A 6/1992 Miller et al.
5,153,900 A 10/1992 Nomikos et al.
5,161,179 A 11/1992 Suzuki et al.
5,173,612 A * 12/1992 Imai et al. ..... 250/505.1
5,196,283 A 3/1993 Ikeda et al.
5,217,817 A 6/1993 Verspui et al.
5,226,067 A 7/1993 Allred et al.
RE34,421 E 10/1993 Parker et al.
5,258,091 A 11/1993 Imai et al.
5,267,294 A 11/1993 Kuroda et al.
5,343,112 A 8/1994 Wegmann
5,391,958 A 2/1995 Kelly
5,400,385 A 3/1995 Blake et al.
5,422,926 A 6/1995 Smith et al.
5,428,658 A 6/1995 Oettinger et al.
5,432,003 A 7/1995 Plano et al.
5,457,041 A 10/1995 Ginaven et al.
5,465,023 A 11/1995 Garner
5,469,429 A 11/1995 Yamazaki et al.
5,469,490 A 11/1995 Golden et al.
5,478,266 A 12/1995 Kelly
5,524,133 A 6/1996 Neale et al.
5,561,342 A 10/1996 Roeder et al.
5,567,929 A 10/1996 Ouimette
RE35,383 E 11/1996 Miller et al.
5,571,616 A 11/1996 Phillips et al.
5,578,360 A 11/1996 Viitanen
5,607,723 A 3/1997 Plano et al.
5,621,780 A 4/1997 Smith et al.
5,627,871 A 5/1997 Wang
5,631,943 A 5/1997 Miles
5,680,433 A 10/1997 Jensen
5,682,412 A 10/1997 Skillicorn et al.
5,696,808 A 12/1997 Lenz
5,729,583 A 3/1998 Tang et al.
5,740,228 A 4/1998 Schmidt et al.
5,774,522 A 6/1998 Warburton
5,812,632 A 9/1998 Schardt et al.
5,835,561 A 11/1998 Moorman et al.
5,870,051 A 2/1999 Warburton
5,898,754 A 4/1999 Gorzen
5,907,595 A 5/1999 Sommerer
6,002,202 A 12/1999 Meyer et al.
6,005,918 A 12/1999 Harris et al.
6,044,130 A 3/2000 Inazura et al.
6,062,931 A 5/2000 Chuang
6,069,278 A 5/2000 Chuang
6,075,839 A 6/2000 Treseder
6,097,790 A 8/2000 Hasegawa et al.
6,133,401 A 10/2000 Jensen
6,134,300 A 10/2000 Trebes et al.
6,184,333 B1 2/2001 Gray
6,205,200 B1 3/2001 Boyer et al.
6,282,263 B1 8/2001 Arndt et al.
6,288,209 B1 9/2001 Jensen
6,307,008 B1 10/2001 Lee et al.
6,320,019 B1 11/2001 Lee et al.
6,351,520 B1 2/2002 Inazaru
6,385,294 B2 5/2002 Suzuki et al.
6,438,207 B1 8/2002 Chidester et al.
6,477,235 B2 11/2002 Chornenky et al.
6,487,272 B1 11/2002 Kutsuzawa
6,487,273 B1 11/2002 Takenaka et al.
6,494,618 B1 12/2002 Moulton
6,546,077 B2 4/2003 Chornenky et al.
6,567,500 B2 5/2003 Rother
6,646,366 B2 11/2003 Hell et al.
6,658,085 B2 12/2003 Sklebitz
6,661,876 B2 12/2003 Turner et al.
6,740,874 B2 5/2004 Doring
6,778,633 B1 8/2004 Loxley et al.
6,799,075 B1 9/2004 Chornenky et al.
6,803,570 B1 10/2004 Bryson, III et al.
6,803,571 B1 10/2004 Mankos et al.
6,816,573 B2 11/2004 Hirano et al.
6,819,741 B2 11/2004 Chidester
6,838,297 B2 1/2005 Iwasaki
6,852,365 B2 2/2005 Smart et al.
6,876,724 B2 4/2005 Zhou
6,956,706 B2 10/2005 Brandon
6,962,782 B1 11/2005 Livache et al.
6,976,953 B1 12/2005 Pelc
6,987,835 B2 1/2006 Lovoi
7,035,379 B2 * 4/2006 Turner et al. ..... 378/140
7,046,767 B2 5/2006 Okada et al.
7,085,354 B2 8/2006 Kanagami
7,130,380 B2 10/2006 Lovoi et al.

(56) References Cited

U.S. PATENT DOCUMENTS

| | | | | |
|---|---|---|---|---|
| 7,130,381 | B2 | 10/2006 | Lovoi et al. | |
| 7,203,283 | B1 | 4/2007 | Puusaari | |
| 7,206,381 | B2 | 4/2007 | Shimono et al. | |
| 7,215,741 | B2 | 5/2007 | Ukita | |
| 7,224,769 | B2 | 5/2007 | Turner | |
| 7,233,647 | B2 | 6/2007 | Turner et al. | |
| 7,286,642 | B2 | 10/2007 | Ishikawa et al. | |
| 7,305,066 | B2 | 12/2007 | Ukita | |
| 7,358,593 | B2 | 4/2008 | Smith et al. | |
| 7,382,862 | B2 | 6/2008 | Bard et al. | |
| 7,428,298 | B2 | 9/2008 | Bard et al. | |
| 7,448,801 | B2 | 11/2008 | Oettinger et al. | |
| 7,448,802 | B2 | 11/2008 | Oettinger et al. | |
| 7,486,774 | B2 | 2/2009 | Cain | |
| 7,526,068 | B2 | 4/2009 | Dinsmore | |
| 7,529,345 | B2 | 5/2009 | Bard et al. | |
| 7,618,906 | B2 | 11/2009 | Meilahti | |
| 7,634,052 | B2 | 12/2009 | Grodzins | |
| 7,649,980 | B2 | 1/2010 | Aoki et al. | |
| 7,657,002 | B2 | 2/2010 | Burke et al. | |
| 7,684,545 | B2 * | 3/2010 | Damento et al. | 378/161 |
| 7,693,265 | B2 | 4/2010 | Hauttmann et al. | |
| 7,709,820 | B2 | 5/2010 | Decker et al. | |
| 7,737,424 | B2 | 6/2010 | Xu et al. | |
| 7,756,251 | B2 * | 7/2010 | Davis et al. | 378/161 |
| 8,498,381 | B2 * | 7/2013 | Liddiard et al. | 378/161 |
| 8,929,515 | B2 * | 1/2015 | Liddiard | 378/140 |
| 2002/0075999 | A1 | 6/2002 | Rother | |
| 2002/0094064 | A1 | 7/2002 | Zhou | |
| 2003/0096104 | A1 | 5/2003 | Tobita et al. | |
| 2003/0117770 | A1 | 6/2003 | Montgomery | |
| 2003/0152700 | A1 | 8/2003 | Asmussen et al. | |
| 2004/0076260 | A1 | 4/2004 | Charles, Jr. et al. | |
| 2004/0131835 | A1 | 7/2004 | Schmitt et al. | |
| 2005/0018817 | A1 | 1/2005 | Oettinger et al. | |
| 2005/0141669 | A1 | 6/2005 | Shimono et al. | |
| 2005/0207537 | A1 | 9/2005 | Ukita | |
| 2006/0098778 | A1 | 5/2006 | Oettinger et al. | |
| 2006/0233307 | A1 | 10/2006 | Dinsmore | |
| 2006/0269048 | A1 | 11/2006 | Cain | |
| 2007/0025516 | A1 | 2/2007 | Bard et al. | |
| 2007/0087436 | A1 | 4/2007 | Miyawaki et al. | |
| 2007/0111617 | A1 | 5/2007 | Meilahti | |
| 2007/0133921 | A1 | 6/2007 | Haffner et al. | |
| 2007/0165780 | A1 | 7/2007 | Durst et al. | |
| 2007/0183576 | A1 | 8/2007 | Burke et al. | |
| 2008/0296479 | A1 | 12/2008 | Anderson et al. | |
| 2008/0296518 | A1 | 12/2008 | Xu et al. | |
| 2008/0317982 | A1 | 12/2008 | Hecht | |
| 2009/0086923 | A1 | 4/2009 | Davis et al. | |
| 2010/0096595 | A1 | 4/2010 | Prud'Homme et al. | |
| 2010/0126660 | A1 | 5/2010 | O'Hara | |
| 2010/0140497 | A1 | 6/2010 | Damiano, Jr. et al. | |
| 2010/0239828 | A1 | 9/2010 | Cornaby et al. | |
| 2010/0243895 | A1 | 9/2010 | Xu et al. | |
| 2010/0248343 | A1 | 9/2010 | Aten et al. | |
| 2010/0285271 | A1 | 11/2010 | Davis et al. | |
| 2010/0323419 | A1 | 12/2010 | Aten et al. | |
| 2011/0017921 | A1 | 1/2011 | Jiang et al. | |
| 2011/0089330 | A1 | 4/2011 | Thoms | |
| 2011/0121179 | A1 * | 5/2011 | Liddiard et al. | 250/336.1 |
| 2012/0025110 | A1 * | 2/2012 | Davis et al. | 250/505.1 |
| 2012/0213336 | A1 | 8/2012 | Liddiard | |
| 2013/0064355 | A1 | 3/2013 | Davis | |
| 2013/0094629 | A1 | 4/2013 | Liddard | |
| 2013/0315380 | A1 * | 11/2013 | Davis et al. | 378/161 |
| 2014/0127446 | A1 * | 5/2014 | Davis et al. | 428/69 |
| 2014/0140487 | A1 * | 5/2014 | Harker et al. | 378/161 |

FOREIGN PATENT DOCUMENTS

| | | |
|---|---|---|
| DE | 19818057 | 11/1999 |
| EP | 0297808 | 1/1989 |
| EP | 0330456 | 8/1989 |
| EP | 0400655 | 5/1990 |
| EP | 0676772 | 3/1995 |
| GB | 1252290 | 11/1971 |
| JP | 57082954 | 8/1982 |
| JP | S6074253 | 4/1985 |
| JP | S6089054 | 5/1985 |
| JP | 3170673 | 7/1991 |
| JP | 05066300 | 3/1993 |
| JP | 5135722 | 6/1993 |
| JP | 06119893 | 7/1994 |
| JP | 6289145 | 10/1994 |
| JP | 6343478 | 12/1994 |
| JP | 8315783 | 11/1996 |
| JP | 2001179844 | 7/2001 |
| JP | 2003/007237 | 1/2003 |
| JP | 2003/088383 | 3/2003 |
| JP | 2003510236 | 3/2003 |
| JP | 2003/3211396 | 7/2003 |
| JP | 4171700 | 6/2006 |
| JP | 2006297549 | 11/2006 |
| KR | 10-2005-0107094 | 11/2005 |
| WO | WO 99/65821 | 12/1999 |
| WO | WO 00/09443 | 2/2000 |
| WO | WO 00/17102 | 3/2000 |
| WO | WO 03/076951 | 9/2003 |
| WO | WO 2008/052002 | 5/2008 |
| WO | WO 2009/009610 | 1/2009 |
| WO | WO 2009/045915 | 4/2009 |
| WO | WO 2009/085351 | 7/2009 |
| WO | WO 2010/107600 | 9/2010 |

OTHER PUBLICATIONS

PCT application EP12167551.6; filing date May 10, 2012; Robert C. Davis; European search report mailed Nov. 21, 2013.

www.moxtek.com, Moxtek, ProLine Series 10 Windows, Ultra-thin Polymer X-Ray Windows, Sep. 2006, 2 pages.

www.moxtek.com, Moxtek, Sealed Proportional Counter X-Ray Windows, Oct. 2007, 3 pages.

www.moxtek.com, X-Ray Windows, ProLINE Series 20 Windows Ultra-thin Polymer X-ray Windows, 2 pages. Applicant believes that this product was offered for sale prior to the filing date of applicant's application.

Yan, Xing-Bin, et al., Fabrications of Three-Dimensional ZnO-Carbon Nanotube (CNT) Hybrids Using Self-Assembled CNT Micropatterns as Framework, 2007. pp. 17254-17259, vol. III.

U.S. Appl. No. 12/239,281, filed Sep. 26, 2008; Robert C. Davis; office action dated May 24, 2012.

U.S. Appl. No. 13/018,667, filed Feb. 1, 2011; Robert C. Davis ; office action dated Oct. 2, 2012.

U.S. Appl. No. 12/899,750, filed Oct. 7, 2010; Steven Liddiard; office action dated Oct. 15, 2012.

U.S. Appl. No. 13/855,575, filed Apr. 2, 2013; Robert C. Davis.

U.S. Appl. No. 12/899,750, filed Oct. 7, 2010; Steven Liddiard; notice of allowance dated Jun. 4, 2013.

U.S. Appl. No. 13/312,531, filed Dec. 6, 2011; Steven Liddiard; office action dated Dec. 20, 2013.

Anderson et al., U.S. Appl. No. 11/756,962, filed Jun. 1, 2007.

Barkan et al., "Improved window for low-energy x-ray transmission a Hybrid design for energy-dispersive microanalysis," Sep. 1995, 2 pages, Ectroscopy 10(7).

Blanquart et al.; "XPAD, a New Read-out Pixel Chip for X-ray Counting"; IEEE Xplore; Mar. 25, 2009.

Comfort, J. H., "Plasma-enhanced chemical vapor deposition of in situ doped epitaxial silicon at low temperatures," J. Appl. Phys. 65, 1067 (1989).

Das, D. K., and K. Kumar, "Chemical vapor deposition of boron on a beryllium surface," Thin Solid Films, 83(1), 53-60, Sep. 4, 1981.

Das, K., and Kumar, K., "Tribological behavior of improved chemically vapor-deposited boron on beryllium," Thin Solid Films, 108(2), 181-188, Oct. 14, 1983.

Grybos et al.; "DEDIX—Development of Fully Integrated Multichannel ASIC for High Count Rate Digital X-ray Imagining systems"; IEEE 2006; Nuclear Science Symposium Conference Record.

(56) References Cited

OTHER PUBLICATIONS

Grybos, "Pole-Zero Cancellations Circuit With Pulse Pile-Up Tracking System for Low Noise Charge-Sensitive Amplifiers"; Mar. 25, 2009; from IEEE Xplore.
Grybos, et al "Measurements of Matching and High Count Rate Performance of Multichannel ASIC for Digital X-Ray Imaging Systems"; IEEE Transactions on Nuclear Science, vol. 54, No. 4, 2007.
Hanigofsky, J. A., K. L. More, and W. J. Lackey, "Composition and microstructure of chemically vapor-deposited boron nitride, aluminum nitride, and boron nitride + aluminum nitride composites," J. Amer. Ceramic Soc. 74, 301 (1991).
Hexcel Corporation; "Prepreg Technology" brochure; Mar. 2005. http://www.hexcel.com/Reso2882urces/DataSheets/Brochure-Data-Sheets/Prepreg_Technology.pdf.
http://www.orau.org/ptp/collection/xraytubescollidge/MachelettCW250.htm, 1999, 2 pgs.
Komatsu, S., and Y. Moriyoshi, "Influence of atomic hydrogen on the growth reactions of amorphous boron films in a low-pressure B.sub.2 H.sub.6 +He+H.sub.2 plasma", J. Appl. Phys. 64, 1878 (1988).
Komatsu, S., and Y. Moriyoshi, "Transition from amorphous to crystal growth of boron films in plasma-enhanced chemical vapor deposition with B.sub.2 H.sub.6 +He," J. Appl. Phys., 66, 466 (1989).
Komatsu, S., and Y. Moriyoshi, "Transition from thermal-to electron-impact decomposition of diborane in plasma-enhanced chemical vapor deposition of boron films from B.sub.2 H.sub.6 +He," J. Appl. Phys. 66, 1180 (1989).
Lee, W., W. J. Lackey, and P. K. Agrawal, "Kinetic analysis of chemical vapor deposition of boron nitride," J. Amer. Ceramic Soc. 74, 2642 (1991).
Lines, U.S. Appl. No. 12/352,864, filed Jan. 13, 2009.
Lines, U.S. Appl. No. 12/726,120, filed Mar. 17, 2010.
Maya, L., and L. A. Harris, "Pyrolytic deposition of carbon films containing nitrogen and/or boron," J. Amer. Ceramic Soc. 73, 1912 (1990).
Michaelidis, M., and R. Pollard, "Analysis of chemical vapor deposition of boron," J. Electrochem. Soc. 132, 1757 (1985).
Micro X-ray Tube Operation Manual, X-ray and Specialty Instruments Inc., 1996, 5 pages.
Moore, A. W., S. L. Strong, and G. L. Doll, "Properties and characterization of codeposited boron nitride and carbon materials," J. Appl. Phys. 65, 5109 (1989).
Nakajima et al; Trial Use of Carbon-Fiber-Reinforced Plastic as a Non-Bragg Window Material of X-Ray Transmission; Rev. Sci. Instrum.; Jul. 1989; pp. 2432-2435; vol. 60, No. 7.
Nakamura, K., "Preparation and properties of amorphous boron nitride films by molecular flow chemical vapor deposition," J. Electrochem. Soc. 132, 1757 (1985).
Neyco, "SEM & TEM: Grids"; catalog; http://www.neyco.fr/pdf/Grids.pdf#page=1, Sep. 2009.
Panayiotatos, et al., "Mechanical performance and growth characteristics of boron nitride films with respect to their optical, compositional properties and density," Surface and Coatings Technology, 151-152 (2002) 155-159.
Perkins, F. K., R. A. Rosenberg, and L. Sunwoo, "Synchrotronradiation deposition of boron and boron carbide films from boranes and carboranes: decaborane," J. Appl. Phys. 69,4103 (1991).
Powell et al., "Metalized polyimide filters for x-ray astronomy and other applications," SPIE, pp. 432-440, vol. 3113, Jul. 11, 1997.
Rankov. A. "A Novel Correlated Double Sampling Poly-Si Circuit for Readout System in Large Area X-Ray Sensors", 2005.
Roca i Cabarrocas, P., S. Kumar, and B. Drevillon, "In situ study of the thermal decomposition of B.sub.2 H.sub.6 by combining spectroscopic ellipsometry and Kelvin probe measurements," J. Appl. Phys. 66, 3286 (1989).
Scholze et al., "Detection efficiency of energy-dispersive detectors with low-energy windows" X-Ray Spectrometry, X-Ray Spectrom, 2005: 34: 473-476.
Sheather, "The support of thin windows for x-ray proportional counters," Journal Phys,E., Apr. 1973, pp. 319-322, vol. 6, No. 4.
Shirai, K., S.-I. Gonda, and S. Gonda, "Characterization of hydrogenated amorphous boron films prepared by electron cyclotron resonance plasma chemical vapor deposition method," J. Appl. Phys. 67, 6286 (1990).
Tamura, et al "Developmenmt of ASICs for CdTe Pixel and Line Sensors", IEEE Transactions on Nuclear Science, vol. 52, No. 5, Oct. 2005.
Tien-Hui Lin et al., "An investigation on the films used as teh windows of ultra-soft X-ray counters." Acta Physica Sinica, vol. 27, No. 3, pp. 276-283, May 1978, abstract only.
U.S. Appl. No. 12/640,154, filed Dec. 17, 2009; Krzysztof Kozaczek.
U.S. Appl. No. 12/726,120, filed Mar. 17, 2010; Michael Lines.
U.S. Appl. No. 12/783,707, filed May 20, 2010; Steven D. Liddiard.
U.S. Appl. No. 12/899,750, filed Oct. 7, 2010; Steven Liddiard.
U.S. Appl. No. 13/018,667, filed Feb. 1, 2011; Lei Pei.
U.S. Appl. No. 13/307,579, filed Nov. 30, 2011; Dongbing Wang.
U.S. Appl. No. 13/312,531, filed Dec. 6, 2011; Steven Liddiard.
Vandenbulcke, L. G., "Theoretical and experimental studies on the chemical vapor deposition of boron carbide," Indust. Eng. Chem. Prod. Res. Dev. 24, 568 (1985).
Viitanen Veli-Pekka et al., Comparison of Ultrathin X-Ray Window Designs, presented at the Soft X-rays in the 21st Century Conference held in Provo, Utah Feb. 10-13, 1993, pp. 182-190.
Wagner et al, "Effects of Scatter in Dual-Energy Imaging: An Alternative Analysis"; IEEE; Sep. 1989, vol. 8. No. 3.
Winter, J., H. G. Esser, and H. Reimer, "Diborane-free boronization," Fusion Technol. 20, 225 (1991).
Wu, et al.; "Mechanical properties and thermo-gravimetric analysis of PBO thin films"; Advanced Materials Laboratory, Institute of Electro-Optical Engineering; Apr. 30, 2006.
www.moxtek.com, Moxtek, AP3 Windows, Ultra-thin Polymer X-Ray Windows, 2 pages, Sep. 2006.
www.moxtek.com, Moxtek, DuraBeryllium X-Ray Windows, 2 pages, May 2007.

* cited by examiner

CARBON COMPOSITE SUPPORT STRUCTURE

CLAIM OF PRIORITY

Priority is claimed to U.S. Provisional Patent Application Nos. 61/486,547, filed on May 16, 2011; 61/495,616, filed on Jun. 10, 2011; and 61/511,793, filed on Jul. 26, 2011; which are herein incorporated by reference.

BACKGROUND

It is important for support members in support structures, such as x-ray window support structures, to be strong but also small in size. Support structures in x-ray windows can support a film. X-ray windows can be used for enclosing an x-ray source or detection device. X-ray windows can be used to separate a pressure differential, such as ambient air pressure on one side of the window and a vacuum on an opposing side, while allowing passage of x-rays through the window.

X-ray windows can include a thin film supported by the support structure, typically comprised of ribs supported by a frame. The support structure can be used to minimize sagging or breaking of the thin film. The support structure can interfere with the passage of x-rays and thus it can be desirable for ribs to be as thin or narrow as possible while still maintaining sufficient strength to support the thin film. The support structure and film are normally expected to be strong enough to withstand a differential pressure of around 1 atmosphere without sagging or breaking.

Materials comprising Silicon have been use as support structures. A wafer of such material can be etched to form the support structure.

Information relevant to x-ray windows can be found in U.S. Pat. Nos. 4,933,557, 7,737,424, 7,709,820, 7,756,251, 8,498,381; U.S. Patent Publication Numbers 2008/0296479, 2011/0121179, 2012/0025110; and U.S. Patent Application Nos. 61/408,472 61/445,878, 61/408,472 all incorporated herein by reference. Information relevant to x-ray windows can also be found in "Trial use of carbon-fiber-reinforced plastic as a non-Bragg window material of x-ray transmission" by Nakajima et al., Rev. Sci. Instrum 60(7), pp. 2432-2435, July 1989.

SUMMARY

It has been recognized that it would be advantageous to provide a support structure that is strong. For x-ray windows, it has been recognized that it would be advantageous to provide a support structure that minimizes attenuation of x-rays. The present invention is directed to support structures, and methods of making support structures, that satisfy these needs.

In one embodiment, the apparatus comprises a support frame defining a perimeter and an aperture and a plurality of ribs comprising a carbon composite material extending across the aperture of the support frame and carried by the support frame. Openings exist between the plurality of ribs. A film can be disposed over, carried by, and span the plurality of ribs and can be disposed over and span the openings. The film can be configured to pass radiation therethrough.

In another embodiment, a method of making a carbon composite support structure comprises pressing at least one sheet of carbon composite between non-stick surfaces of pressure plates and heating the sheet(s) to at least 50° C. to cure the sheet(s) into a carbon composite wafer. Each sheet can have a thickness of between 20 to 350 micrometers (μm).

The wafer can then be removed and a plurality of openings can be laser cut in the wafer, forming ribs.

DEFINITIONS

Figure 1:
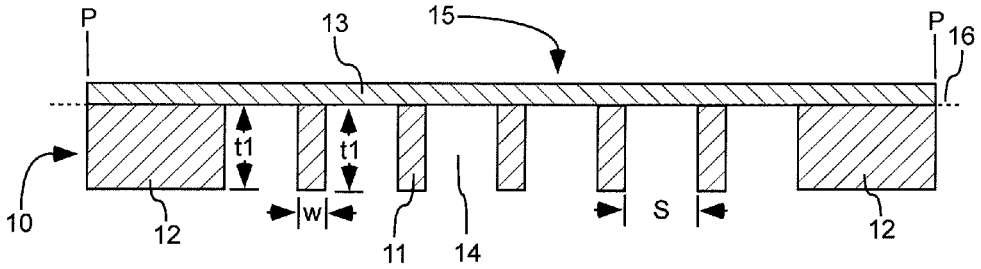
FIG. 1 is a schematic cross-sectional side view of a carbon composite support structure, in accordance with an embodiment of the present invention.

As used herein, the terms "about" or "approximately" are used to provide flexibility to a numerical value or range by providing that a given value may be "a little above" or "a little below" the endpoint.

As used herein, the term "carbon fiber" or "carbon fibers" means solid, substantially cylindrically shaped structures having a mass fraction of at least 85% carbon, a length of at least 5 micrometers and a diameter of at least 1 micrometer.

As used herein, the term "directionally aligned," in referring to alignment of carbon fibers with ribs, means that the carbon fibers are substantially aligned with a longitudinal axis of the ribs and does not require the carbon fibers to be exactly aligned with a longitudinal axis of the ribs.

As used herein, the term "rib" means a support member and can extend, linearly or with bends or curves, by itself or coupled with other ribs, across an aperture of a support frame.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

DETAILED DESCRIPTION

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIG. 1, a support structure 10 is shown comprising a support frame 12 and a plurality of ribs 11. The support frame 12 can include a perimeter P and an aperture 15. The plurality of ribs 11 can comprise a carbon composite material and can extend across the aperture 15 of the support frame 12 and can be carried by the support frame 12. Openings 14 can exist between the plurality of ribs 11. Tops of the ribs 11 can terminate substantially in a common plane 16.

The carbon composite material can comprise carbon fibers embedded in a matrix. The carbon fibers can comprise a carbon mass fraction of at least 85% in one embodiment, at least 88% in another embodiment, at least 92% in another embodiment, or 100% in another embodiment. The carbon fibers can comprise carbon atoms connected to other carbon atoms by $sp_2$ bonding. The carbon fibers can have a diameter of at least 1 micrometer in one embodiment, at least 3 micrometers in another embodiment, or at least 5 micrometers in another embodiment. Most, substantially all, or all of the carbon fibers can have a length of at least 1 micrometer in one embodiment, at least 10 micrometers in another embodiment, at least 100 micrometers in another embodiment, at least 1 millimeter in another embodiment, or at least 5 millimeters in another embodiment. Most, at least 80%, substantially all, or all of the carbon fibers can be aligned with a rib. Most, at least 80%, substantially all, or all of the carbon fibers can have a length that is at least half the length of the rib with which it is aligned in one embodiment, or at least as long as the rib with which it is aligned in another embodiment. The carbon fibers can be substantially straight.

In one embodiment, such as if the support structure 10 is used as an x-ray window, a film 13 can be disposed over, carried by, and span the plurality of ribs 11 and can be disposed over and span the openings 14. The film 13 can be configured to pass radiation therethrough. For example, the film 13 can be made of a material that has a low atomic number and can be thin, such as for example about 5 to 500 micrometers (μm). The film 13 can have sufficient strength to allow differential pressure of at least one atmosphere without breaking. The film 13 can be hermetic or air-tight. The film 13 can combine with one of the support structures described herein and a shell to form a hermetic enclosure.

The film 13 can comprise highly ordered pyrolytic graphite, silicon nitride, polymer, polyimide, beryllium, carbon nanotubes, carbon nanotubes embedded in a polymer, diamond, diamond-like carbon, graphene, graphene embedded in a polymer, boron hydride, aluminum, or combinations of these various materials. The film 13 can include a stack of layers, and different layers in the stack can comprise different materials.

In one embodiment, the film 13 comprises a plurality of layers stacked together, including an aluminum layer disposed over a thin film layer comprising a material selected from the group consisting of highly ordered pyrolytic graphite, silicon nitride, polymer, polyimide, beryllium, carbon nanotubes, carbon nanotubes embedded in a polymer, diamond, diamond-like carbon, graphene, graphene embedded in a polymer, boron hydride, and combinations thereof. Aluminum can be a gas barrier in order to provide a hermetic film. Aluminum can be used to prevent visible light from passing through the window. In one embodiment, the aluminum layer can have a thickness of between 10 to 60 nanometers.

The film 13 can include a protective layer over the aluminum layer. The protective layer can provide corrosion protection for the aluminum. The protective layer can comprise amino phosphonate, silicon nitride, silicon dioxide, borophosphosilicate glass, fluorinated hydrocarbon, polymer, bismaleimide, silane, fluorine, or combinations thereof. The protective layer can be applied by chemical vapor deposition, atomic layer deposition, sputter, immersion, or spray. A polymer protective layer can comprise polyimide. Use of amino phosphonate as a protective layer is described in U.S. Pat. No. 6,785,050, incorporated herein by reference.

In some applications, such as analysis of x-ray fluorescence, it can be desirable for the film 13 to comprise elements having low atomic numbers such as hydrogen (1), beryllium (4), boron (5), and carbon (6). The following materials consist of, or include a large percent of, the low atomic number elements hydrogen, beryllium, boron, and carbon: highly ordered pyrolytic graphite, polymer, beryllium, carbon nanotubes, carbon nanotubes embedded in a polymer, diamond, diamond-like carbon, graphene, graphene embedded in a polymer, and boron hydride.

Figure 2:
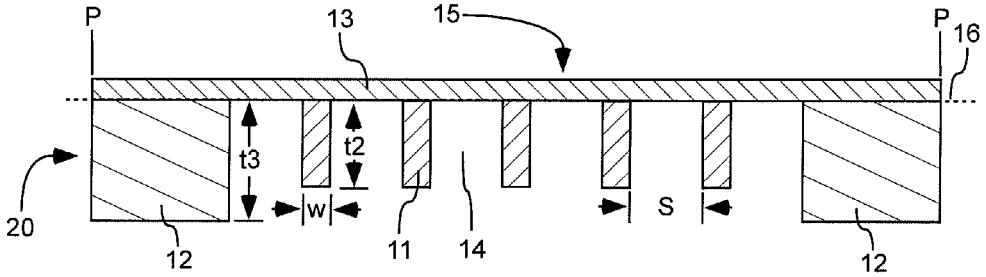
FIG. 2 is a schematic cross-sectional side view of a carbon composite support structure, in accordance with an embodiment of the present invention.

In one embodiment, the support frame 12 comprises a carbon composite material. The support frame 12 and the plurality of ribs 11 can be integrally formed together from at least one layer of carbon composite material. As shown in FIG. 1, the support frame 12 and the plurality of ribs 11 can have substantially the same thickness t1, As shown in FIG. 2, the plurality of ribs 11 and support frame 12 of support structure 20 can be separately formed, can be formed of separate materials and/or can have different thicknesses (t2≠t3). In one embodiment, a thickness t3 of the support frame 12 can be at least 10% thicker than a thickness t2 of the ribs $$11\left(\frac{t3-t2}{t2}>0.1\right).$$

In another embodiment, a thickness t3 of the support frame 12 can be at least 20% thicker than a thickness t2 of the ribs $$11\left(\frac{t3-t2}{t2}>0.2\right).$$

In another embodiment, a thickness t3 of the support frame 12 can be at least 50% thicker than a thickness t2 of the ribs $$11\left(\frac{t3-t2}{t2}>0.5\right).$$

For simplicity of manufacture, it can be desirable to form the plurality of ribs 11 and the support frame 12 in a single step from a single wafer of carbon composite, as shown in FIG. 1. In one embodiment, the support frame 12 and the plurality of ribs 11 were integrally formed together from at least one layer of carbon composite material. Having the support frame 12 and the plurality of ribs 11 integrally formed together from at least one layer of carbon composite material can be beneficial for simplicity of manufacturing. For a stronger support frame 12 compared to the plurality of ribs 11, it can be desirable to form the plurality of ribs 11 and support frame 12 separately and have a thicker support frame 12, as shown in FIG. 2.

In one embodiment, the plurality of ribs 11 and/or support frame 12 can have a thickness t of between 20 to 350 micrometers (μm) and/or a width of between 20 to 100 micrometers (μm). In another embodiment, the plurality of ribs 11 and/or support frame 12 can have a thickness t of between 10 to 300 micrometers (μm) and/or a width w of between 10-200 micrometers (μm). In one embodiment, a spacing S between adjacent ribs 11 can be between 100 to 700 micrometers (μm). In another embodiment, a spacing S between adjacent ribs can be between 700 micrometers (μm) and 1 millimeter (mm). In another embodiment, a spacing S between adjacent ribs can be between 1 millimeter and 10 millimeters. A larger spacing S allows x-rays to more easily pass through the window but also provides less support for the film 13. A smaller spacing S may result in increased, undesirable attenuation of x-rays but also provides greater support for the film 13.

Use of carbon composite material, which can have high strength, in a support structure, can allow a high percentage of open area within the support frame 12 and/or reduce the overall height of the plurality of ribs 11, both of which are desirable characteristics because both increase the ability of the window to pass radiation. The openings 14 can occupy more area within the perimeter P of the support frame 12 than the plurality of ribs 11 in one embodiment. In various embodiments, the openings 14 can occupy greater than 70%, greater than 90%, between 70% to 90%, between 85% to 95%, between 90% to 99%, or between 99% to 99.9% of the area within the perimeter P of the support frame 12 than the plurality of ribs 11.

Embodiments with openings 14 occupying a very large percent of the area within the perimeter P of the support frame 12 may be used in an application in which a strong film is used and only needs minimal support. Such embodiments may also be used in an application in which at least one additional support structure, such as an additional polymer support structure, is disposed between the carbon composite support structure and the film 13. The additional support structure can be the secondary support structure 128 shown in FIG. 12 or the secondary support structure 158 shown in FIG. 15.

Figure 3:
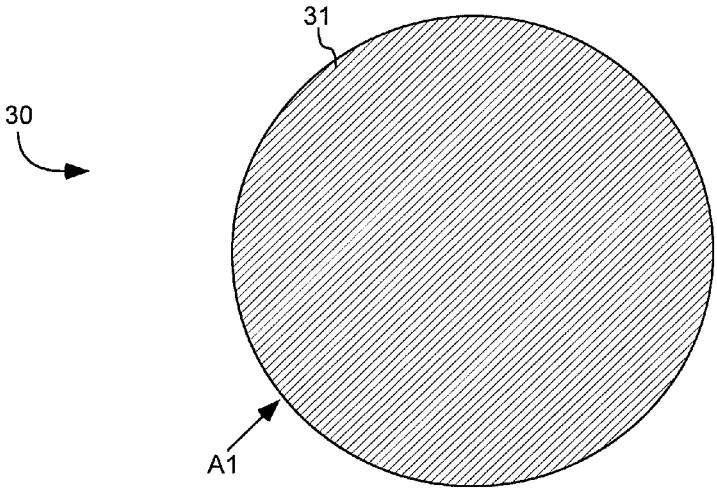
FIG. 3 is a schematic top view of a carbon composite wafer in accordance with an embodiment of the present invention.
Figure 4:
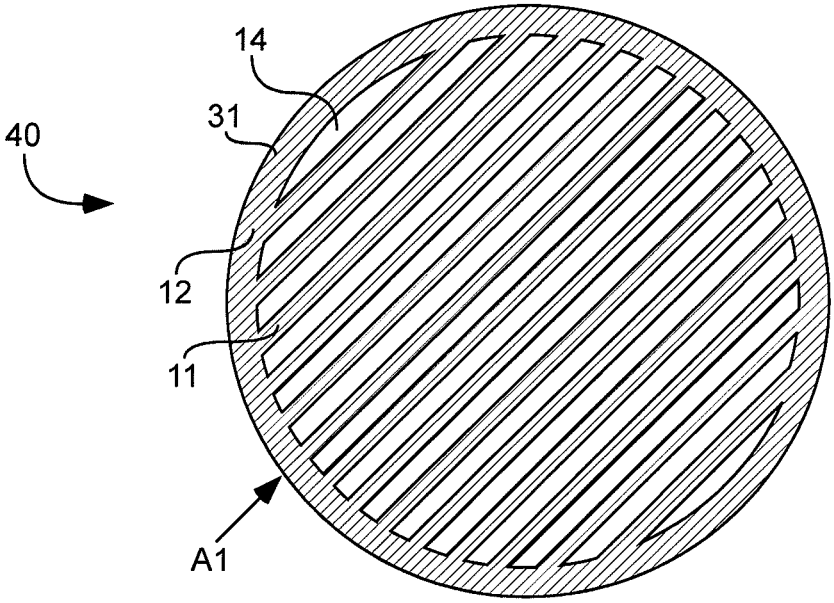
FIG. 4 is a schematic top view of a carbon composite support structure, wherein carbon fibers in a carbon composite material are directionally aligned with a longitudinal axis of a plurality of ribs across an aperture of a support frame, in accordance with an embodiment of the present invention.

As shown in FIG. 3, a carbon composite sheet 30 can have carbon fibers 31 aligned substantially in a single direction, such as along longitudinal axis A1. As shown in support structure 40 in FIG. 4, carbon fibers 31 can be aligned such that the carbon fibers 31 in the carbon composite material are directionally aligned with a longitudinal axis A1 of the plurality of ribs 11 across the aperture.

In various figures and embodiments, the carbon fibers 31 in the carbon composite material can be directionally aligned with a longitudinal axis A1 of the plurality of ribs 11. In one embodiment, all of the carbon fibers 31 can be directionally aligned with a longitudinal axis A1 of the plurality of ribs 11. In another embodiment, substantially all of the carbon fibers 31 can be directionally aligned with a longitudinal axis A1 of the plurality of ribs 11. In another embodiment, at least 80% of the carbon fibers 31 can be directionally aligned with a longitudinal axis A1 of the plurality of ribs 11. In another embodiment, at least 60% of the carbon fibers 31 can be directionally aligned with a longitudinal axis A1 of the plurality of ribs 11.

The carbon fibers 31 can comprise solid structures having a length that is at least 5 times greater than a diameter of the carbon fibers 31 in one embodiment, a length that is at least 10 times greater than a diameter of the carbon fibers 31 in another embodiment, a length that is at least 100 times greater than a diameter of the carbon fibers 31 in another embodiment, or a length that is at least 1000 times greater than a diameter of the carbon fibers 31 in another embodiment.

Figure 5:
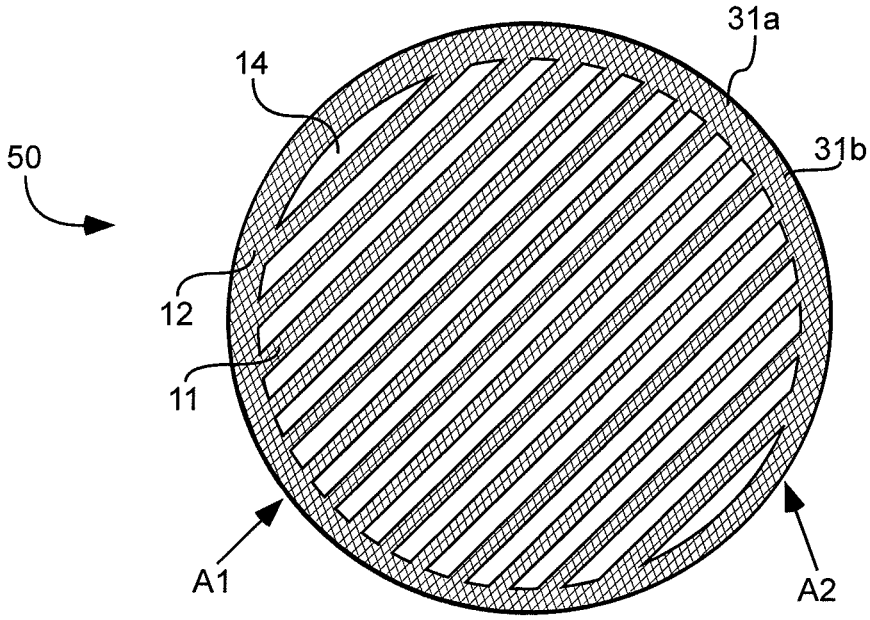
FIG. 5 is a schematic top view of a carbon composite support structure comprising a carbon composite material that includes carbon fibers directionally aligned in two different directions; in accordance with an embodiment of the present invention.

In one embodiment, carbon composite material in a support structure can comprise a stack of at least two carbon composite sheets. Carbon fibers 31 in at least one sheet in the stack can be directionally aligned in a different direction from carbon fibers 31 in at least one other sheet in the stack. For example, support structure 50 shown in FIG. 5 includes a carbon composite sheet with carbon fibers 31*a* aligned in one direction A1 and at least one carbon composite sheet with carbon fibers 31*b* aligned in another direction A2. In the various embodiments described herein, the support frame 12 can be made from the same carbon composite sheet(s) as the plurality of ribs 11, or the support frame 12 can be made separately from the plurality of ribs 11 and can be made from a different material.

In one embodiment, an angle between sheets having carbon fibers 31 aligned in different directions is at least ten degrees (|A2−A1|>10 degrees). In another embodiment, an angle between sheets having carbon fibers 31 aligned in different directions is at least thirty degrees (|A2−A1|>30 degrees). In another embodiment, an angle between sheets having carbon fibers 31 aligned in different directions is at least forty five degrees (|A2−A1|>45 degrees). In another embodiment, an angle between sheets having carbon fibers 31 aligned in different directions is at least sixty degrees (|A2−A1|>60 degrees).

In another embodiment, carbon fibers 31 in the carbon composite material can be randomly aligned. For example, an initial sheet with randomly aligned carbon fibers may be used. Alternatively, many sheets can be stacked and randomly aligned. The sheets can be pressed together and cut to form the desired support structure.

Figure 6:
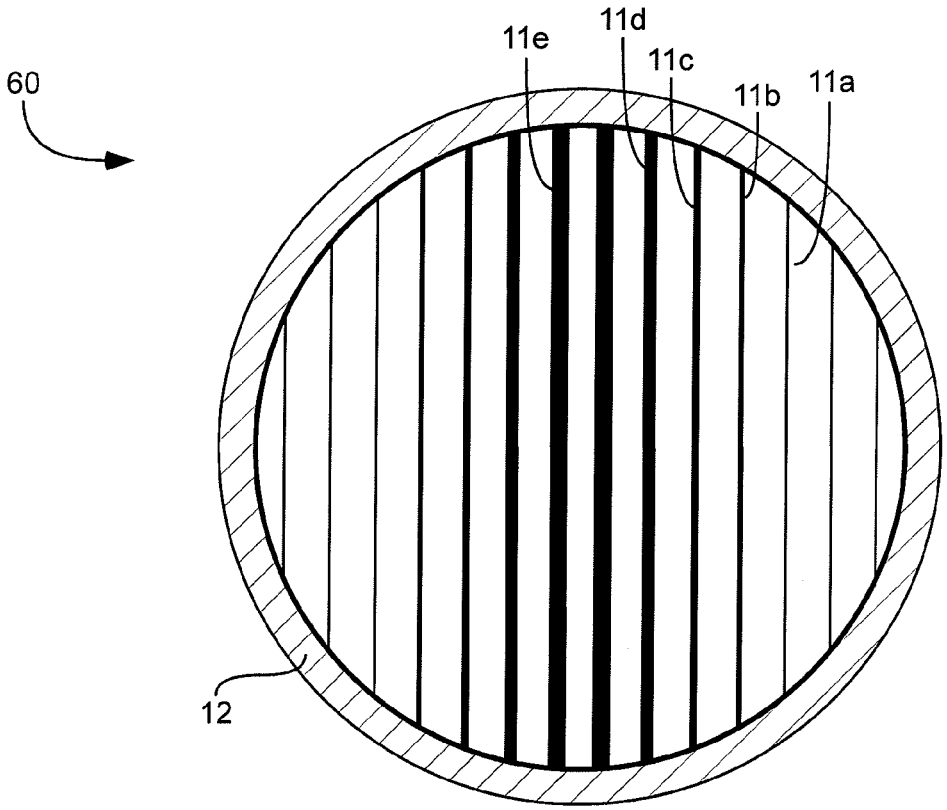
FIG. 6 is a schematic top view of a carbon composite support structure with ribs that have at least two different cross-sectional sizes, in accordance with an embodiment of the present invention.

As shown in FIG. 6, a support structure 60 can include multiple sized ribs 11*a-e*. For example, different ribs can have different cross-sectional sizes. This may be accomplished by cutting some ribs with larger widths w and other ribs with smaller widths w. Five different rib cross-sectional sizes are shown in FIG. 6 (11*e*>11*d*>11*c*>11*b*>11*a*).

In one embodiment, the plurality of ribs 11 have at least two different cross-sectional sizes including at least one larger sized rib with a cross-sectional area that is at least 5% larger than a cross-sectional area of at least one smaller sized rib. In another embodiment, a difference in cross-sectional area between different ribs can be at least 10%. In another embodiment, a difference in cross-sectional area between different ribs can be at least 20%. In another embodiment, a difference in cross-sectional area between different ribs can be at least 50%. Different rib cross-sectional sizes is described in U.S. Patent Application Publication Number 2012/0213336 which claims priority to provisional U.S. Patent Application No. 61/445,878, filed on Feb. 23, 2011, both incorporated herein by reference.

Figure 7:
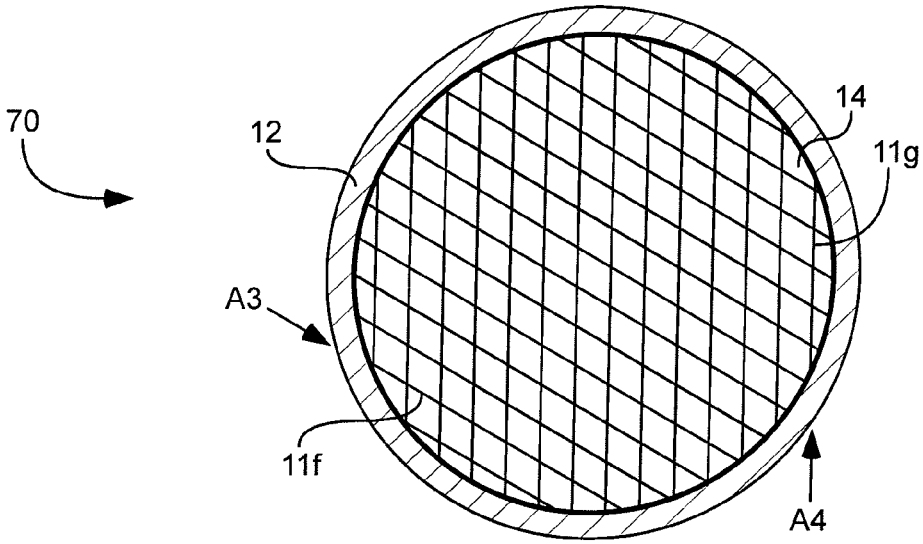
FIG. 7 is a schematic top view of a carbon composite support structure with intersecting ribs, in accordance with an embodiment of the present invention.

As shown in FIG. 7, a support structure 70 can include a plurality of ribs 11 extending in different directions A3 and A4. For example, one rib or group of ribs 11*f* can extend in one direction A3 and another rib or group of ribs 11*g* can extend in another direction A4. Ribs extending in different directions can cross perpendicularly or non-perpendicularly. Carbon fibers can be aligned with a longitudinal direction of the ribs. For example, in FIG. 7, some of the carbon fibers can be directionally aligned with a longitudinal axis A3 of one rib or group of ribs 11*f* and other carbon fibers can be directionally aligned with a longitudinal axis A4 of another rib or group of ribs 11*g*. In one embodiment, carbon fibers can be substantially aligned in one of two different directions A3 or A4.

Figure 8:
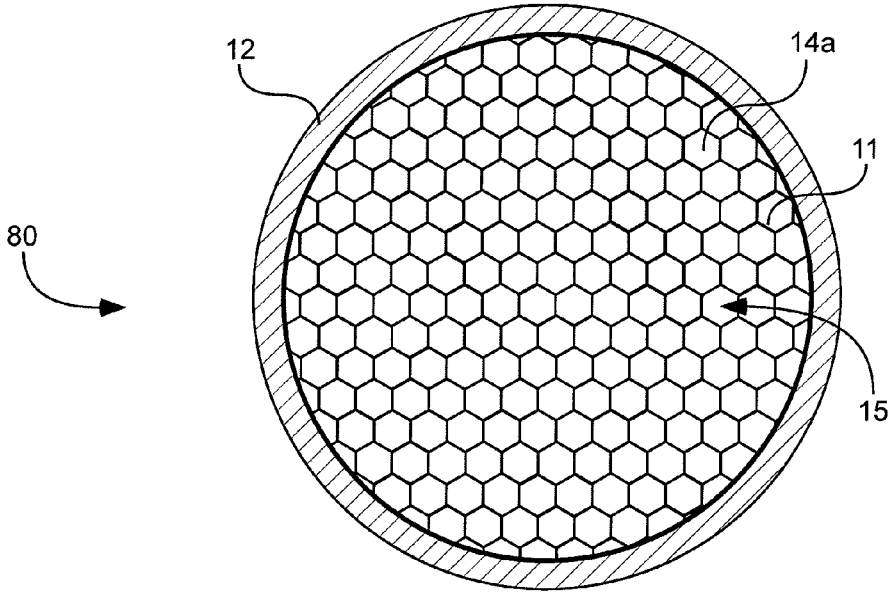
FIG. 8 is a schematic top view of a carbon composite support structure with hexagonal shaped openings and hexagonal shaped ribs, in accordance with an embodiment of the present invention.

As shown in FIG. 8, a support structure 80 can include a plurality of ribs 11 that extend nonlinearly across the aperture 15 of the support frame 12. The plurality of ribs 11 can be arranged to form a single hexagonal shaped opening or multiple hexagonal shaped openings 14*a* as shown in FIG. 8.

Figure 9:
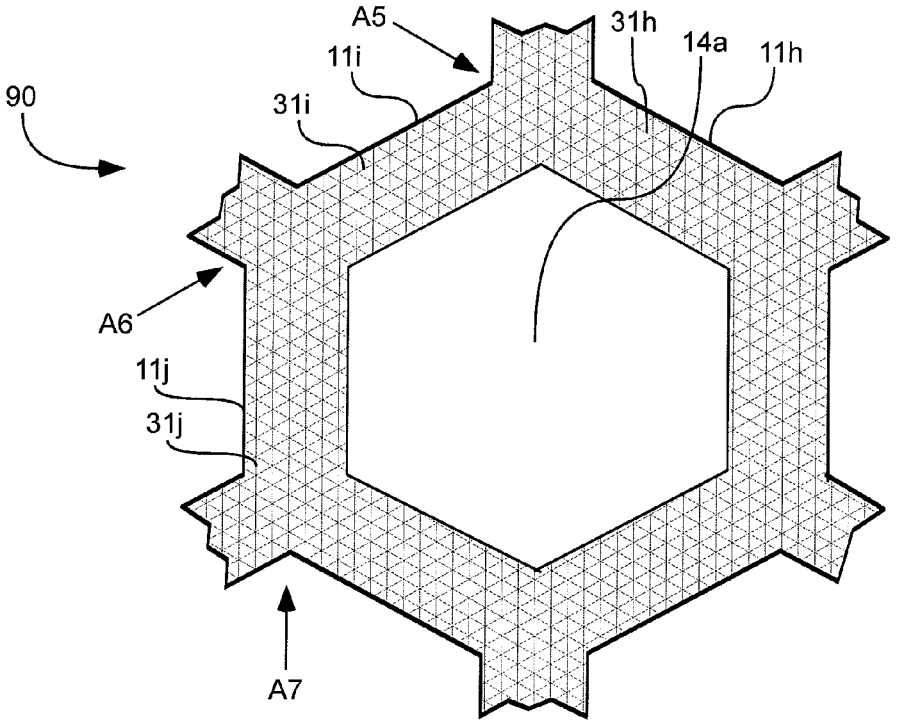
FIG. 9 is a schematic top view of a section of a carbon composite support structure with a hexagonal shaped opening, hexagonal shaped ribs, and carbon fibers directionally aligned with longitudinal axes of the ribs, in accordance with an embodiment of the present invention.

Shown in FIG. 9 is an expanded section of the plurality of ribs 11 of a support structure 90 with carbon fibers aligned in three different directions A5-A7 and directionally aligned with a longitudinal axis A5-A7 of at least one rib 11. One group of carbon fibers 31*h* can be directionally aligned A5 with at least one rib 11*h*, another group of carbon fibers 31*i* can be directionally aligned A6 with at least one other rib 11*i*, and another group of carbon fibers 31*j* can be directionally aligned A7 with at least one other rib 11*j*. Hexagonal-shaped carbon composite support members, especially with carbon fibers aligned with the plurality of ribs 11, can provide a strong support structure.

Figure 10:
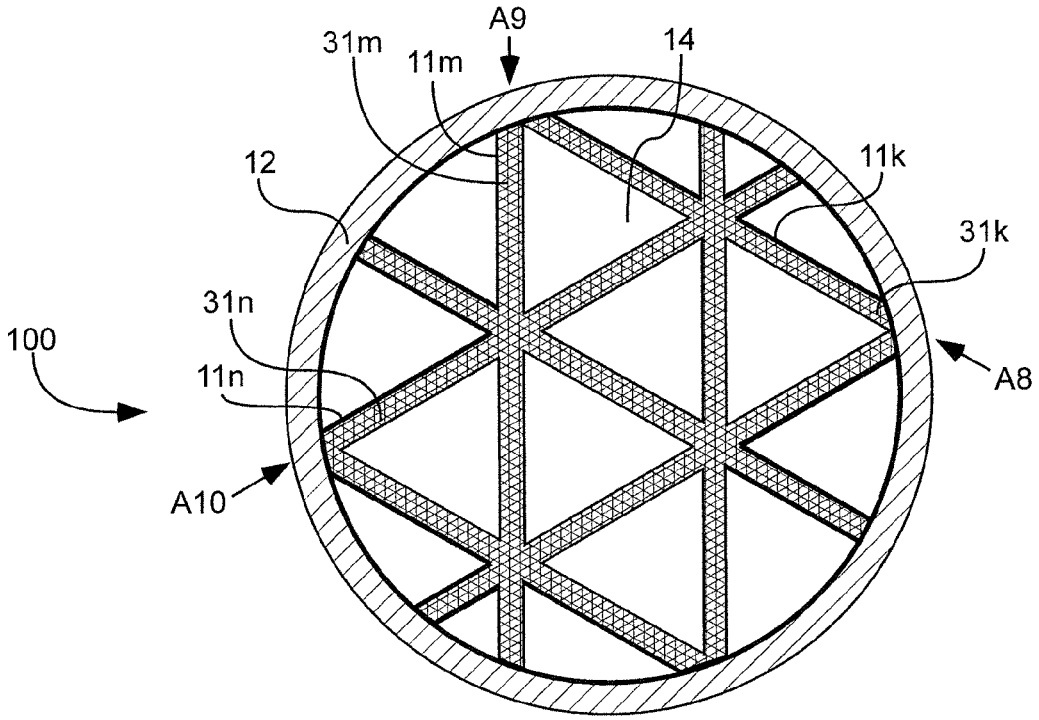
FIG. 10 is a schematic top view of a carbon composite support structure with triangular shaped openings, triangular shaped ribs, and carbon fibers directionally aligned with longitudinal axes of the ribs, in accordance with an embodiment of the present invention.

Shown in FIG. 10 is a support structure 100 with carbon fibers aligned in three different directions A8-A10 and directionally aligned with a longitudinal axis A8-A10 of at least one rib 11. One group of carbon fibers 31*k* can be directionally aligned A8 with at least one rib 11*k*, another group of carbon fibers 31*m* can be directionally aligned A9 with at least one other rib 11*m*, and another group of carbon fibers 31*n* can be directionally aligned A10 with at least one other rib 11*n*. Triangular-shaped carbon composite support members, especially with carbon fibers aligned with the ribs 11, can provide a strong support structure.

Choice of arrangement of ribs, whether all in parallel, in hexagonal shape, in triangular shape, or other shape, can be made depending on needed strength, distance the ribs must span, type of film supported by the ribs, and manufacturability.

Figure 11:
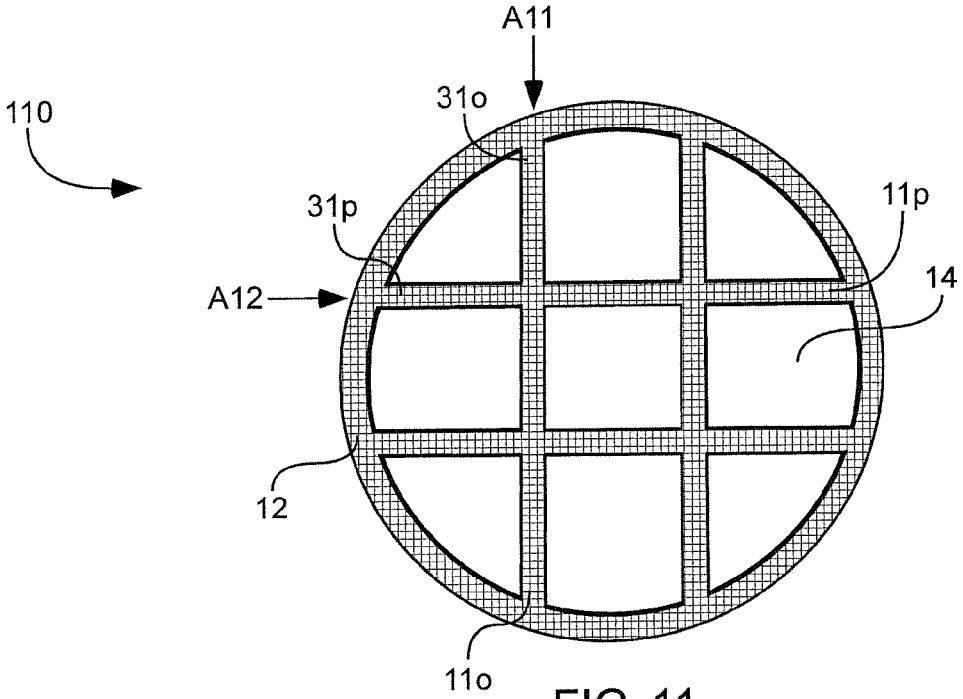
FIG. 11 is a schematic top view of a carbon composite support structure with two ribs extending in one direction and two ribs extending in a different direction and carbon fibers that are directionally aligned with longitudinal axes of the ribs, in accordance with an embodiment of the present invention.

As shown in FIG. 11, a support structure 110 can include a small number of ribs 11, such as for example two ribs 11 in each of two different directions A11-A12. Alternatively, the support structure 110 could include only a single rib, a single rib in each of two different directions, or a single rib in each of at least three different directions. This may be desirable for supporting a film 13 that is very strong, and only needs minimal support. Carbon fibers 31*p* & 31*o* can be directionally aligned with longitudinal axes of ribs 11. For example, as shown in FIG. 11, carbon fibers 31*o* can be directionally aligned with a longitudinal axis A11 of ribs 11*o* and carbon fibers 31*p* can be directionally aligned with a longitudinal axis A12 of ribs 11*p*.

Figure 12:
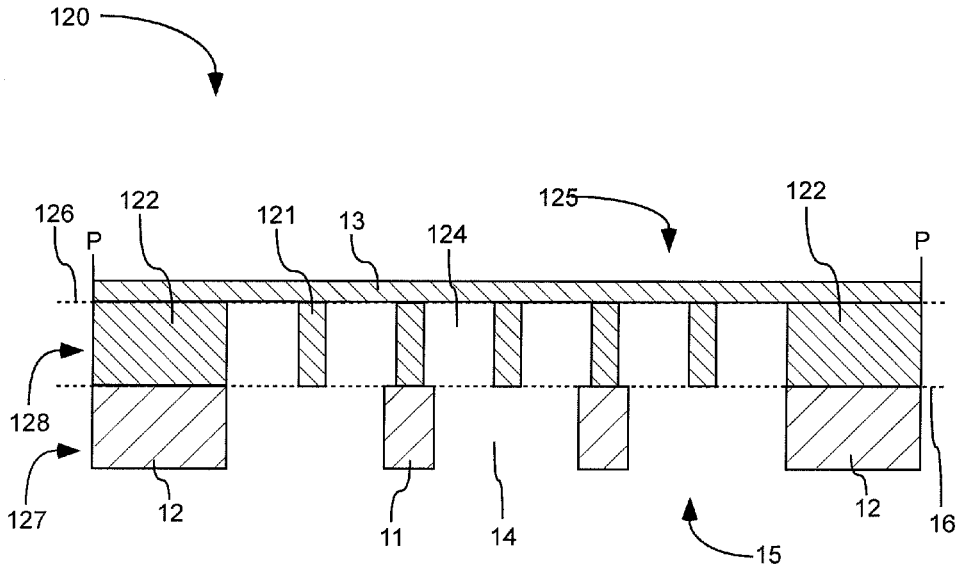
FIG. 12 is a schematic cross-sectional side view of multiple stacked support structures, including a carbon composite support structure, in accordance with an embodiment of the present invention.

Shown in FIG. 12, a support structure 120 can include multiple stacked support structures 127-128. A primary support structure 127 can comprise a primary support frame 12 defining a perimeter P and an aperture 15; a plurality of primary ribs 11 extending across the aperture 15. The primary ribs 11 can be carried by the primary support frame 12. Openings 14 can exist between the primary ribs 11. The ribs can comprise a carbon composite material. The primary support structure 127 can be made according to one of the various carbon composite support structures described herein. Tops of the primary ribs 11 can terminate substantially in a single plane 16.

A secondary support structure 128 can be stacked on top of the primary support structure 127, and thus between the primary support structure 127 and the film 13, as shown in FIG. 12. Alternatively, the primary support structure 127 can be stacked on top of the secondary support structure 128, and thus the primary support structure 127 can be disposed between the secondary support structure 128 and the film 13. The secondary support structure 128 can attach to the primary support structure 127 at a plane 16 at which primary ribs 11 terminate.

The secondary support structure 128 can comprise a secondary support frame 122 defining a perimeter P and an aperture 125 and a plurality of secondary ribs 121 extending across the aperture 125. The secondary ribs 121 can be carried by the secondary support frame 122. Openings 124 can exist between the secondary ribs 121. The secondary support structure 128 can be disposed at least partly between the primary support structure 127 and a film 13 or the secondary support structure 128 can be disposed completely between the primary support structure 127 and the film 13. Tops of the secondary ribs 121 can terminate substantially in a single plane 126.

In one embodiment, the secondary support frame 122 and secondary support ribs 121 are integrally formed and can be made of the same material. In another embodiment, the secondary support frame 122 and secondary ribs 121 are not integrally formed, are separately made then attached together, and can be made of different materials.

In another embodiment, the primary support frame 12 and the secondary support frame 122 are a single support frame and support both the primary ribs 11 and the secondary ribs 121. The primary support frame 12 and the secondary support frame 122 can be integrally formed and can be made of the same material. The primary support frame 12, the primary ribs 11, and the secondary support frame 122 can be integrally formed and can be made of the same material. The secondary ribs 121 can thus be supported by the primary ribs 11, the primary support frame 12, and/or the secondary support frame 122.

In one embodiment, primary ribs 11 provide support for the secondary ribs 121, and thus may be called a secondary support frame 122 for the secondary ribs 121. For example, a primary support structure 127 can be formed, secondary ribs 121 can be formed, then the secondary ribs 121 can be placed on top of or attached to the primary support structure 127. An adhesive can be sprayed onto the primary or secondary support structure or both and the two support structures can be pressed and adhered together by the adhesive.

In one embodiment, the secondary support structure 128 comprises a polymer. In another embodiment, the secondary support structure 128 comprises photosensitive polyimide. Use of photosensitive polymers for support structures is described in U.S. Pat. No. 5,578,360, incorporated herein by reference.

Figure 13:
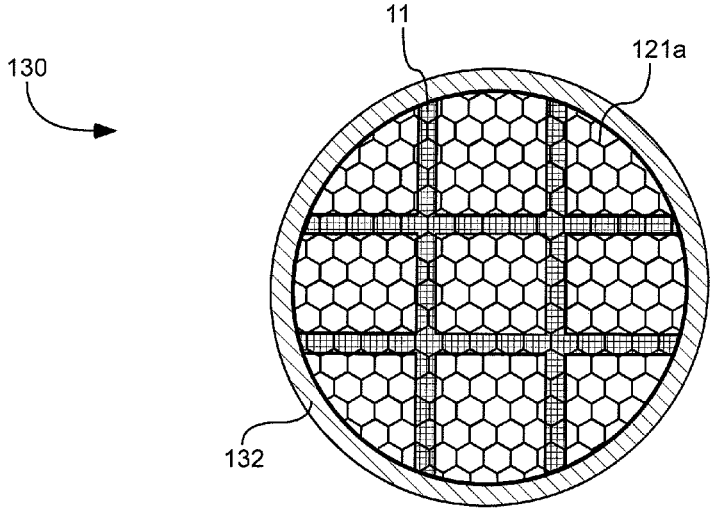
FIG. 13 is a schematic top view of a stacked support structure including a carbon composite support structure, in accordance with an embodiment of the present invention.
Figure 14:
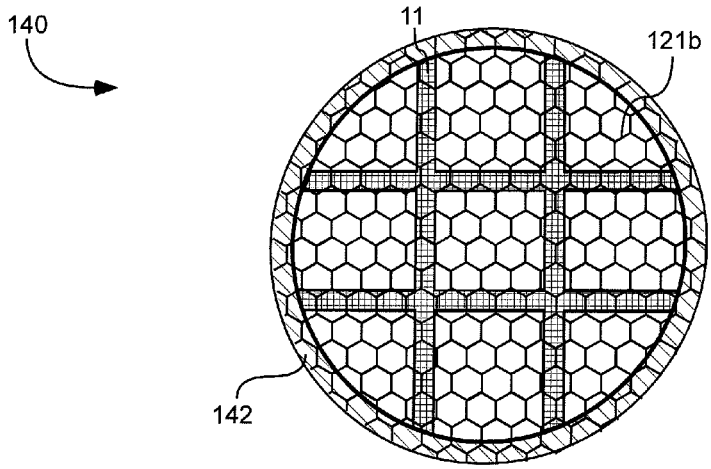
FIG. 14 is a schematic top view of a stacked support structure including a carbon composite support structure, in accordance with an embodiment of the present invention.

FIGS. 13-14 show a top view of support structures 130 & 140, each with a primary and secondary support structure. In FIG. 13, secondary ribs 121*a* are supported by primary ribs 11 and by secondary support frame 132. In FIG. 14, secondary ribs 121*b* are supported by primary ribs 11 and by primary support frame 142. Thus, support frame 142 can serve as both primary and secondary support frame.

Figure 15:
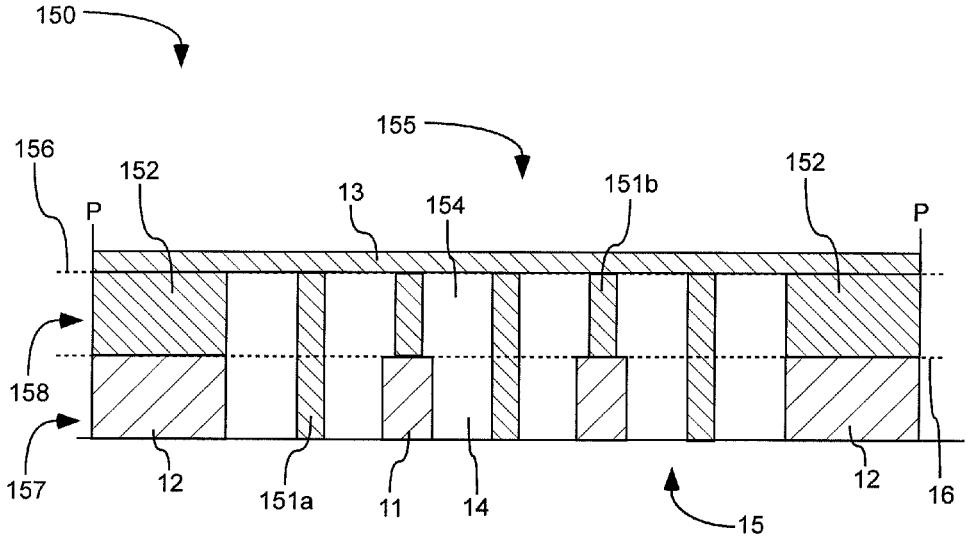
FIG. 15 is a schematic cross-sectional side view of a multilayer support structure including a carbon composite support structure, in accordance with an embodiment of the present invention.

Shown in FIG. 15, support structure 150 can include multiple stacked support structures 157-158. A primary support structure 157 can comprise a primary support frame 12 defining a perimeter P and an aperture 15; a plurality of primary ribs 11 extending across the aperture 15. The primary ribs 11 can be carried by the primary support frame 12. Openings 14 can exist between the primary ribs 11. The ribs 11 can comprise a carbon composite material. The primary support structure 157 can be made according to one of the various carbon composite support structures described herein.

A secondary support structure 158 can be disposed at least partly on top of the primary support structure 157. The secondary support structure 158 can comprise a secondary support frame 152 defining a perimeter P and an aperture 155 and a plurality of secondary ribs 151 extending across the aperture 155. The secondary ribs 151 can be carried by the secondary support frame 158 and/or the primary ribs 11. Openings 154 can exist between the secondary ribs 151. The secondary support structure 158 can be disposed at least partly between the first support structure 157 and a film 13. Tops of the secondary ribs 151 can terminate substantially in a single plane 156.

Some secondary ribs 151*b* can be disposed between primary ribs 11 or the primary support structure 12 and the film 13. Other ribs 151*a* can extend down and be disposed partly between primary ribs 11. This embodiment can be made by first creating a primary support structure 157, then pouring a liquid photosensitive polymer on top of the primary support structure 157. The photosensitive polymer can be patterned and developed to form ribs 151 and to harden the polymer.

Stacked support structures may be useful for spanning large distances. For example, it can be impractical to use a polymer support structure to span large distances. Use of an underlying carbon composite support structure can allow the polymer support structure to span the needed large distance.

Figure 16:
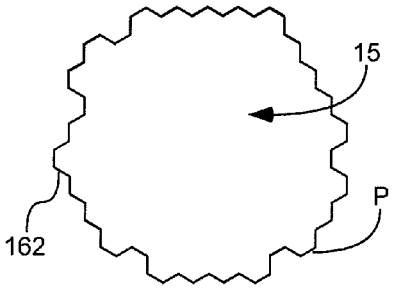
FIG. 16 is a schematic top view of an irregular-shaped support frame, in accordance with an embodiment of the present invention.
Figure 17:
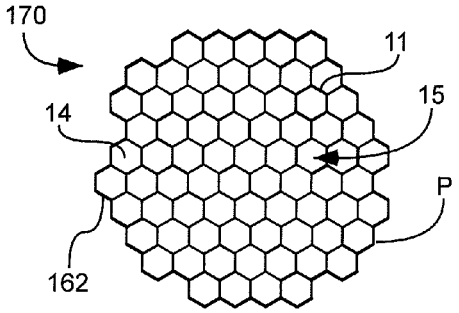
FIG. 17 is a schematic top view of a support structure with an irregular-shaped support frame, in accordance with an embodiment of the present invention.

Most of the figures herein show circular support frames. Although it may be more convenient to use circular support frames, other support frame shapes may be used with the various embodiments described herein. Shown in FIG. 16 is an irregular shaped support frame 162 with a perimeter P and aperture 15. Shown in FIG. 17 is support structure 170 with ribs 11 attached to irregular shaped support frame 162. Outer ribs may form the support frame.

Figure 18:
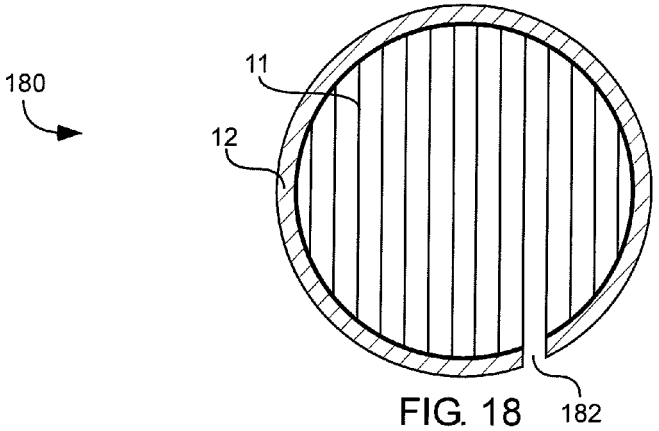
FIG. 18 is a schematic top view of a support structure with a support frame that does not completely surround or enclose the ribs, in accordance with an embodiment of the present invention.

Most of the figures herein show support frames which totally surround and enclose ribs. A support frame with an enclosed perimeter can provide greater strength and support for ribs and thus is a preferred embodiment, however, the various embodiments described herein are not limited to fully enclosed support frames. Shown in FIG. 18 is a support structure 180 that has an opening 182 in the support frame 12. Thus the support frame 12 need not totally surround and enclose ribs 11. The embodiments shown in FIGS. 16-18 are applicable to the various embodiments of support structures described herein.

Figure 19:
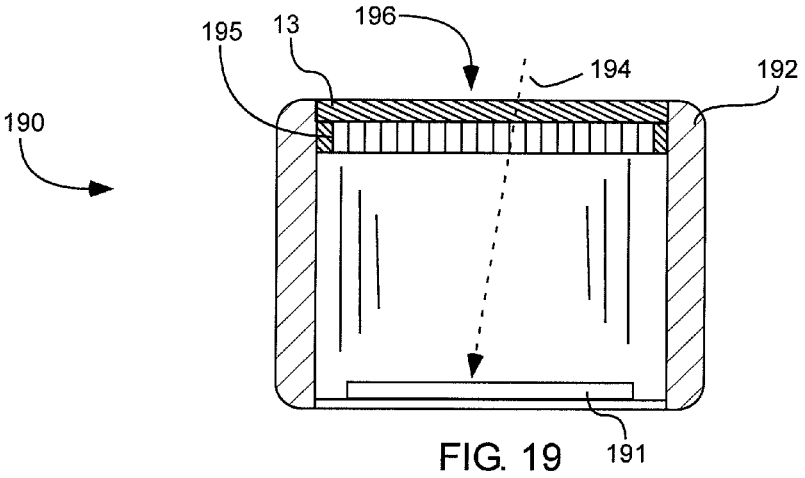
FIG. 19 is a schematic cross-sectional side view of an x-ray detector, in accordance with an embodiment of the present invention.

As shown in FIG. 19, an x-ray detection unit 190 can include a support structure 195 according to one of the embodiments described herein. A film 13 can be disposed over the support structure 195. The support structure 195 and the film 13 can comprise an x-ray window 196. The x-ray window 196 can be hermetically sealed to a mount 192. An x-ray detector 191 can also be attached to the mount 192. The mount 192 and window 196 can comprise a hermetically sealed enclosure. The window 196 can be configured to allow x-rays 194 to impinge upon the detector 191, such as by selecting a window 196 that will allow x-rays 194 to pass therethrough and by aligning the detector 191 with the window 196. In one embodiment, the support frame 12 and the mount 192 are the same and the plurality of ribs 11 are attached to this support frame 12 and mount 192. The film 13 can be hermetically sealed to the mount 192 and an x-ray detector 191 can be attached to the mount 192. The x-ray window 196 and mount 192 can also be used with proportional counters, gas ionization chambers, and x-ray tubes.

Figure 20:
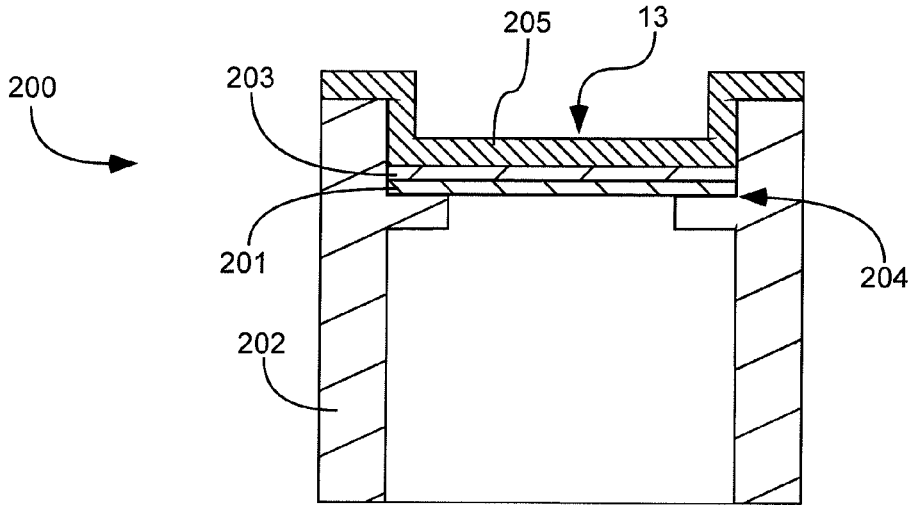
FIG. 20 is a schematic cross-sectional side view of an x-ray window attached to a mount, in accordance with an embodiment of the present invention.

As shown in FIG. 20, a mounted window 200 can include a film 13 disposed over a support structure 201 attached to a mount 202. The support structure 201 can be one of the embodiments described herein including carbon composite ribs 11. The film 13 can comprise a plurality of layers stacked together, including a thin film layer 203 and an outer layer 205. The outer layer 205 can include at least one layer of polymer, at least one layer of boron hydride, at least one layer of aluminum, or combinations of these layers. The thin film 203 can be comprised of a material selected from the group consisting of highly ordered pyrolytic graphite, silicon nitride, polymer, polyimide, beryllium, carbon nanotubes, carbon nanotubes embedded in a polymer, diamond, diamond-like carbon, graphene, graphene embedded in a polymer, or combinations of these various materials.

The thin film layer 203, the support structure 201, or both can be hermetically sealed to a mount 202, defining a sealed joint 204. The outer layer 205 can extend beyond a perimeter of the thin film layer 203 and can cover the sealed joint 204. The outer layer 205 can provide corrosion protection to the sealed joint.

Figure 23:
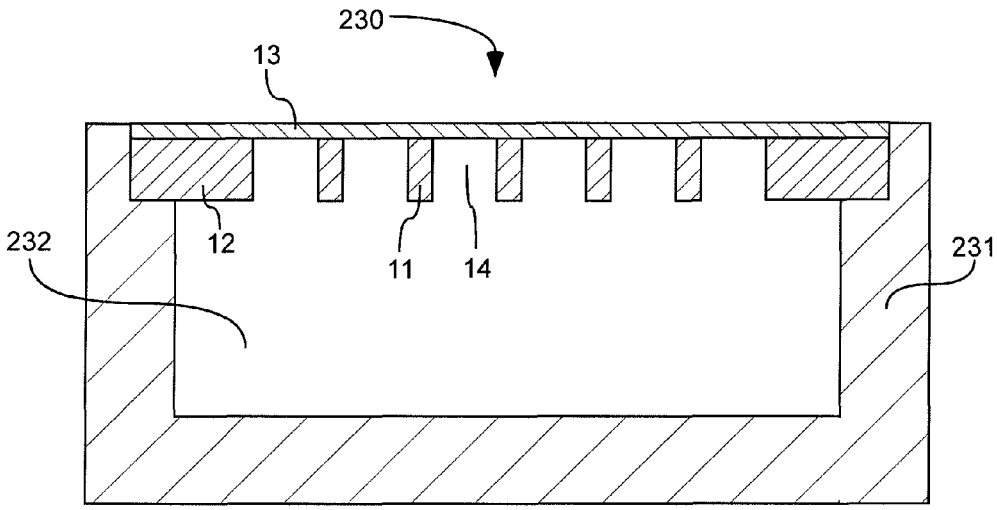
FIG. 23 is a schematic cross-sectional side view of an x-ray window attached to a mount, with the support frame facing the interior of the mount; in accordance with an embodiment of the present invention.
Figure 24:
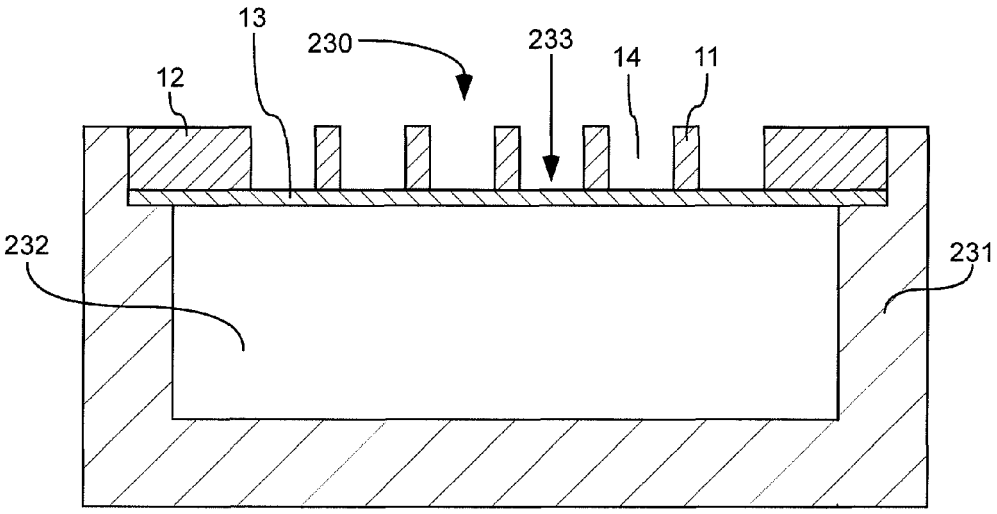
FIG. 24 is a schematic cross-sectional side view of an x-ray window attached to a mount, with the support frame facing the exterior of the mount; in accordance with an embodiment of the present invention.

Shown in FIGS. 23-24, an x-ray window 230 can be attached to a mount 231. The window 230 can be hermetically sealed to the mount 231. The x-ray window 230 can be one of the various embodiments described herein. The window 230 and mount 231 can enclose an interior space 232. The interior space 232 can be a vacuum.

As shown in FIG. 23, the plurality of ribs 11 can be disposed between the film 13 and the interior space 232. As shown in FIG. 24, the film 13 can be disposed between the plurality of ribs 11 and the interior space 232, thus the plurality of ribs 11 can be separated from the interior space 232 by the film 13.

Having the plurality of ribs 11 between the film 13 and the interior space 232, as shown in FIG. 23, can allow for easier support of the film 13, but this embodiment may have a disadvantage of certain carbon composite material components outgassing into the vacuum of the interior space 232, thus decreasing the vacuum. Whether this problem occurs is dependent on the level of vacuum and the type of carbon composite material used.

One way of solving the problem of carbon composite material components outgassing into the interior space 232 is to dispose the film 13 between the plurality of ribs 11 and the interior space 232. A difficulty of this design is that gas pressure 233 outside of the window 230 and mount 231 can press the film 13 away from the support frame 12 and/or plurality of ribs 11. Thus, a stronger bond between the film 13 and the plurality of ribs 11 and/or support frame 12 may be needed for the embodiment of FIG. 24.

This stronger bond between the film 13 and the plurality of ribs 11 and/or support frame 12 can be achieved by use of polyimide or other high strength adhesive. The adhesive may need to be selected to achieve desired temperatures to which the window will be subjected. An adhesive which will not outgas may also need to be selected. The bond between the film 13 and the plurality of ribs 11 and/or support frame 12 may be improved by treating the surface of the plurality of ribs 11, support frame 12, and/or film 13 prior to joining the surfaces. The surface treatment can include use of a potassium hydroxide solution or an oxygen plasma.

Another method of solving the problem of carbon composite material outgassing into the interior space 232 is to select carbon composite materials that will not outgas, or will have minimal outgassing. A carbon composite material including carbon fibers embedded in a matrix comprising polyimide and/or bismaleimide may be preferable due to low outgassing. Polyimide and bismaleimide are also suitable due to their ability to withstand high temperatures and their structural strength.

Figure 25:
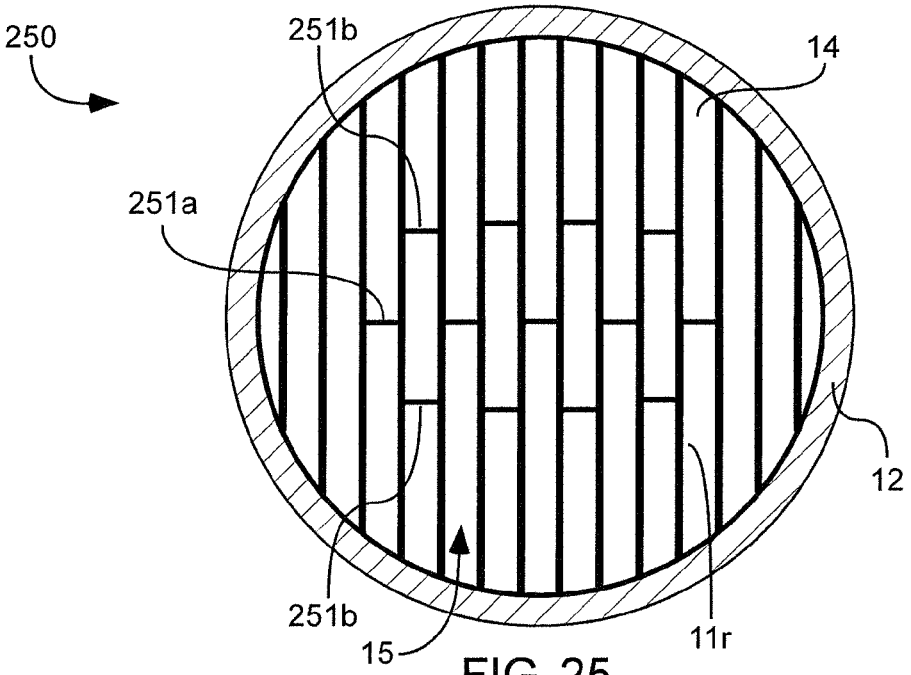
FIG. 25 is a schematic top view of a carbon composite support structure, including a plurality of cross-braces disposed between a plurality of ribs, in accordance with an embodiment of the present invention.
Figure 26:
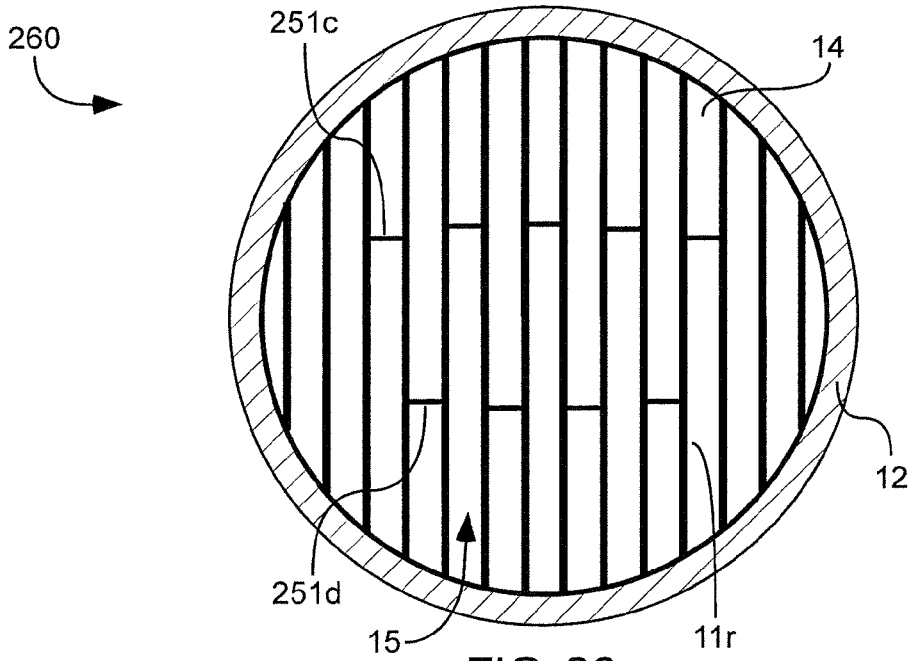
FIG. 26 is a schematic top view of a carbon composite support structure, including a plurality of cross-braces disposed between a plurality of ribs, in accordance with an embodiment of the present invention.

As shown on x-ray windows 250 and 260 in FIGS. 25-26, the plurality of ribs 11*r* can be substantially straight and parallel with respect to one another and arrayed across the aperture 15 of the support frame. The x-ray windows 250 and 260 can further comprise a plurality of intermediate support cross-braces 251 extending between adjacent ribs of the plurality of ribs 11*r*. The cross-braces 251 can span an opening between adjacent ribs without spanning the aperture 15 of the support frame. The cross-braces 251 can comprise a carbon composite material. The plurality of cross-braces 251 can be substantially perpendicular to the plurality of ribs 11*r*.

The cross-braces 251 can be laterally off-set with respect to adjacent cross-braces 251 of adjacent openings so that the cross-braces 251 are segmented and discontinuous with respect to one another. For example, in FIG. 25, central cross braces 251*a* are disposed between alternating pairs of ribs 11*r* and disposed at approximately a midpoint across the aperture 15; outer cross braces 251*b* are disposed between alternating pairs of ribs 11*r* and offset from the midpoint across the aperture 15. Thus, central cross braces 251*a* and outer cross braces 251*b* are both disposed between alternating pairs of ribs 11*r*, but the central cross braces 251*a* are disposed between different alternating pairs of ribs 11*r* than the outer cross braces 251*b*.

The cross-braces 251 can be disposed at approximately one third of a distance in a straight line parallel with the ribs from the support frame across the aperture. The cross-braces 251 can be laterally off-set with respect to adjacent cross-braces 251 of adjacent openings so that the cross-braces 251 can be segmented and discontinuous with respect to one another. For example, in FIG. 26, upper cross braces 251*c* (called upper due to their position in the upper part of the figure) can be disposed between alternating pairs of ribs 11*r* and disposed at approximately one third of the distance across the aperture 15. Lower cross braces 251*d* (called lower due to their position in the lower part of the figure) can be disposed between alternating pairs of ribs 11*r*, different from the alternating pairs of ribs 11*r* between which upper cross braces 251*c* are disposed. Lower cross braces 251*d* can be disposed at a one third distance across the aperture 15, but this one third distance is from an opposing side of the aperture 15 from the upper cross braces 251*c*.

How to Make:

Carbon composite sheets (or a single sheet) can be used to make a carbon composite wafer. Due to the toughness of carbon composite material, it can be difficult to cut the small ribs required for an x-ray window. Ribs can be cut into the wafer, in a desired pattern, by laser mill (also called laser ablation or laser cutting).

The optimal matrix material can be selected based on the application. A carbon composite material including carbon fibers embedded in a matrix comprising polyimide and/or bismaleimide may be preferable due to low outgassing, ability to withstand high temperatures, and high structural strength.

A composite with carbon fibers with sufficient length can be selected to improve structural strength. Carbon fibers that extend across the entire aperture of the window may be preferred for some applications.

Carbon composite sheet(s) can comprise carbon fibers embedded in a matrix. The matrix can comprise a polymer, such as polyimide. The matrix can comprise bismaleimide. The matrix can comprise amorphous carbon or hydrogenated amorphous carbon. The matrix can comprise a ceramic. The ceramic can comprise silicon nitride, boron nitride, boron carbide, or aluminum nitride.

In one embodiment, carbon fibers can comprise 10-40 volumetric percent of the total volume of the carbon composite material and the matrix can comprise the remaining volumetric percent. In another embodiment, carbon fibers can comprise 40-60 volumetric percent of the total volume of the carbon composite material and the matrix can comprise the remaining volumetric percent. In another embodiment, carbon fibers can comprise 60-80 volumetric percent of the total volume of the carbon composite material and the matrix can comprise the remaining volumetric percent. Carbon fibers in the carbon composite can be substantially straight.

A carbon wafer can be formed by pressing, at an elevated temperature, such as in an oven for example, at least one carbon composite sheet between pressure plates. Alternatively, rollers can be used to press the sheets. The pressure plates or rollers can be heated in order to heat the sheets. The sheets can be heated to at least 50° C. A single sheet or multiple sheets may be used. Carbon fibers in the carbon composite sheet(s) can be randomly aligned, can be aligned in a single direction, can be aligned in two different directions, can be aligned in three different directions, or can be aligned in more than three different directions.

A layer of polyimide can be bonded (such as with pressure) to one surface of the carbon composite sheet(s) prior to pressing the sheets. The polyimide layer can be placed between carbon composite sheets, or on an outer face of a stack of carbon composite sheets. The polyimide layer can be cut along with the carbon composite sheet(s) into ribs and can remain as a permanent part of the final support structure. The layer of polyimide film can be between 5 and 20 micrometers thick in one embodiment. One purpose of the polyimide layer is to make one side of the carbon composite sheet(s) smooth and flat, allowing for easier bonding of the x-ray window film. Another purpose is to improve final rib strength. The layer of polyimide can be replaced by another suitable polymer. High temperature resistance and high strength are two desirable characteristics of the polymer.

In one embodiment, carbon fibers of a single sheet, or carbon fibers of all sheets in a stack, are aligned in a single direction. A first group of ribs, or a single rib, can be cut such that a longitudinal axis of the rib(s) is aligned in the direction of the carbon fibers.

In another embodiment, at least two carbon composite sheets are stacked and pressed into the wafer. Carbon fibers of at least one sheet are aligned in a first direction and carbon fibers of at least one other sheet are aligned in a second direction. A first group of ribs, or a single rib, can be cut having a longitudinal axis in the first direction to align with the carbon fibers aligned in the first direction and a second group of ribs, or a single rib, can be cut having a longitudinal axis in the second direction to align with the carbon fibers aligned in the second direction. In one embodiment, an angle between the two different directions is least 10 degrees. In another embodiment, an angle between the two different directions is least 60 degrees. In another embodiment, an angle between the two different directions is about 90 degrees.

In another embodiment, at least three carbon composite sheets are stacked and pressed into the wafer. Carbon fibers of at least one sheet are aligned in a first direction, carbon fibers of at least one sheet are aligned in a second direction, and carbon fibers of at least one sheet are aligned in a third direction. A first group of ribs, or a single rib, can be cut having a longitudinal axis in the first direction to align with the carbon fibers aligned in the first direction, a second group of ribs, or a single rib, can be cut having a longitudinal axis in the second direction to align with the carbon fibers aligned in the second direction, and a third group of ribs, or a single rib, can be cut having a longitudinal axis in the third direction to align with the carbon fibers aligned in the third direction. An angle between any two directions can be about 120 degrees. The structure can form hexagonal-shaped or triangular-shaped openings.

In one embodiment, each carbon composite sheet in a stack can have a thickness of between 20 to 350 micrometers (μm).

Figure 21:
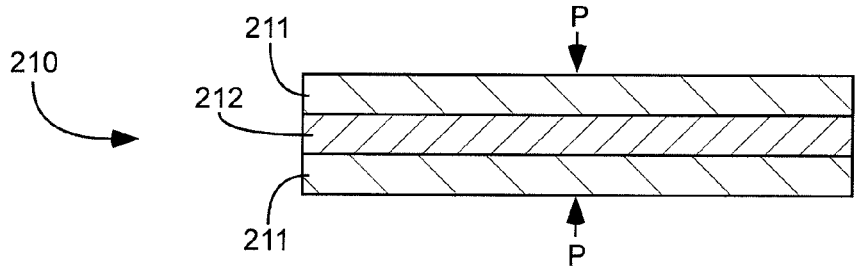
FIG. 21 is a schematic cross-sectional side view showing pressing and heating at least one sheet of carbon composite to form a carbon composite wafer, in accordance with an embodiment of the present invention.

The plates used for pressing the carbon composite sheets into a wafer can have non-stick surfaces facing the sheet(s) of carbon composite. The plates can have fluorinated flat silicon surfaces facing the sheets. For example, FIG. 21 shows a press 210 including two plates 211 and at least one carbon composite sheet 212 between the two plates 211. The carbon composite sheet(s) 212 can include a layer of polyimide or other polymer.

Pressure P can be applied to the carbon composite sheet(s) 212 and the carbon composite sheet(s) (and optionally a layer of polymer, such as polyimide) can be heated to a temperature of at least 50° C. to cure the sheet(s) of carbon composite into a carbon composite wafer. Temperature, pressure, and time can be adjusted based on thicknesses of the sheets, the number of sheets, matrix material, and desired final characteristics of the wafer. For example, carbon composite sheets comprising carbon fibers in a polyimide matrix have been made into wafers at pressures of 200-3000 psi, temperatures of 120-200° C., and initial sheet thickness of 180 micrometer (μm).

The wafer can be removed from the press and the wafer can be cut to form ribs and/or support frame. The wafer may be cut by laser milling or laser ablation. A high power laser can use short pulses of laser to ablate the material to form the openings by ultrafast laser ablation. A femtosecond laser may be used. Ablating wafer material in short pulses of high power laser can be used in order to avoid overheating the polymer material in the carbon composite. Alternatively, a non-pulsing laser can be used and the wafer can be cooled by other methods, such as conductive or convective heat removal. The wafer can be cooled by water flow or air across the wafer. The above mentioned cooling methods can also be used with laser pulses, such as a femtosecond laser, if additional cooling is needed.

The ribs, formed by the laser, can be formed of a single original layer of carbon composite material or multiple layers of carbon composite material and can include at least one layer of polyimide. If a polyimide layer is used in the stack, then the ribs can comprise carbon composite and polyimide and thus polyimide ribs will be attached to and aligned with the carbon composite ribs.

Figure 22:
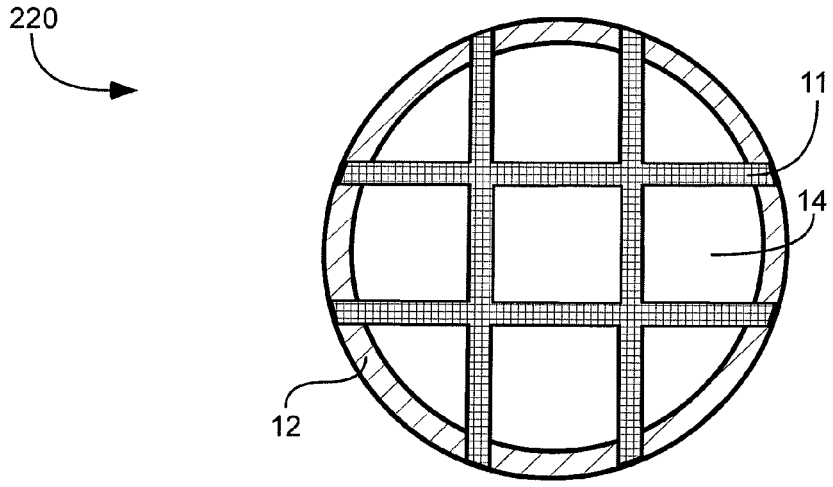
FIG. 22 is a schematic top view of ribs disposed over and supported by a support frame, in accordance with an embodiment of the present invention.

As shown in support structure 220 in FIG. 22, ribs 11 can be formed separately from the support frame 12. Ribs 11 can then be laid on top of the support frame 12. An adhesive may be used to hold the ribs in place. The support frame 12 can be a ring a material or a mount, such as mount 192 shown in FIG. 19 or mount 202 shown in FIG. 20.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A window for allowing transmission of x-rays, comprising:

a) a support frame defining a perimeter and an aperture;

b) a plurality of ribs comprising a carbon composite material extending across the aperture of the support frame and carried by the support frame, the support frame and the plurality of ribs comprising a support structure;

c) wherein the carbon composite material comprises carbon fibers embedded in a matrix;

d) wherein the plurality of ribs form openings between the plurality of ribs;

e) a film disposed over, carried by, and spanning the plurality of ribs and disposed over and spanning the openings, and configured to pass radiation therethrough;

f) wherein the plurality of ribs are substantially straight and parallel with respect to one another and arrayed across the aperture of the support frame;

g) a plurality of intermediate support cross-braces:

i. comprising a carbon composite material;

ii. extending between adjacent ribs of the plurality of ribs; and iii. spanning an opening between adjacent ribs without spanning the aperture of the support frame;

iv. including upper cross braces and lower cross braces, the upper cross braces being disposed in adjacent openings with respect to the lower cross braces; and v. the upper cross braces and the lower cross braces being laterally off-set with respect to each other so that the plurality of intermediate support cross-braces are segmented and discontinuous with respect to one another.

2. The window of claim 1, wherein the plurality of intermediate support cross-braces are disposed at approximately one third of a distance in a straight line parallel with the plurality of ribs from the support frame across the aperture.

3. The window of claim 1, wherein the plurality of intermediate support cross-braces are substantially perpendicular to the plurality of ribs.

4. An x-ray detection unit comprising:

a mount; and the window of claim 3 hermetically sealed to the mount, and wherein:

a) the window and the mount enclose an interior space; and b) the plurality of ribs are separated from the interior space by the film.

5. A window for allowing transmission of x-rays, comprising:

a) a support frame defining a perimeter and an aperture;

b) a plurality of ribs comprising a carbon composite material extending across the aperture of the support frame and carried by the support frame, the support frame and the plurality of ribs comprising a support structure;

c) wherein the carbon composite material comprises carbon fibers embedded in a matrix;

d) wherein the plurality of ribs form openings between the plurality of ribs; and e) a film disposed over, carried by, and spanning the plurality of ribs and disposed over and spanning the openings, and configured to pass radiation therethrough;

f) wherein the support frame comprises a carbon composite material; and g) the support frame and the plurality of ribs were integrally formed together from at least one layer of carbon composite material.

6. The window of claim 5, wherein:

a) the support structure defines a primary support structure;

b) a secondary support structure is disposed at least partly between the primary support structure and the film;

c) the secondary support structure comprises:

i. a secondary support frame defining a secondary perimeter and a secondary aperture;

ii. a plurality of secondary ribs extending across the secondary aperture of the secondary support frame and carried by the secondary support frame; and iii. openings between the plurality of secondary ribs.

7. The window of claim 6, wherein the secondary support structure comprises a photosensitive polyimide.

8. A window for allowing transmission of x-rays, comprising:

a. a support frame defining a perimeter and an aperture;

b. a plurality of ribs comprising a carbon composite material extending across the aperture of the support frame and carried by the support frame, the support frame and the plurality of ribs comprising a support structure;

c. wherein the carbon composite material comprises carbon fibers embedded in a matrix;

d. wherein the plurality of ribs form openings between the plurality of ribs;

e. a film disposed over, carried by, and spanning the plurality of ribs and disposed over and spanning the openings, and configured to pass radiation therethrough;

f. wherein at least 80% of the carbon fibers in the carbon composite material are directionally aligned with a longitudinal axis of the plurality of ribs across the aperture; and g. wherein at least 80% of the carbon fibers in the carbon composite material have a length that is at least half as long as a rib in which it is comprised.

9. The window of claim 8, wherein:

a) the support frame is formed separately from the plurality of ribs; and b) the support frame is at least 20% thicker than the plurality of ribs.

10. The window of claim 8, wherein the plurality of ribs comprising a carbon composite material define carbon composite ribs, and further comprise a layer of polyimide ribs attached to and aligned with the carbon composite ribs, and wherein the layer of polyimide ribs is disposed between the carbon composite ribs and the film.

11. A window for allowing transmission of x-rays, comprising:

a. a support frame defining a perimeter and an aperture;

b. a plurality of ribs comprising a carbon composite material extending across the aperture of the support frame and carried by the support frame, the support frame and the plurality of ribs comprising a support structure;

c. wherein the carbon composite material comprises carbon fibers embedded in a matrix;

d. wherein the plurality of ribs form openings between the plurality of ribs;

e. a film disposed over, carried by, and spanning the plurality of ribs and disposed over and spanning the openings, and configured to pass radiation therethrough;

f. wherein the plurality of ribs includes intersecting ribs;

g. wherein tops of the plurality of ribs terminate substantially in a common plane;

h. wherein the carbon composite material includes a stack of at least two carbon composite sheets; and i. wherein carbon fibers in each of the stack of at least two carbon composite sheets are directionally aligned with a longitudinal axis of at least one of the plurality of ribs.

12. The window of claim 11, wherein the matrix comprises an amorphous carbon or a hydrogenated amorphous carbon.

13. The window of claim 11, wherein the matrix comprises a material selected from the group consisting of polyimide, bismaleimide, and combinations thereof.

14. The window of claim 11, wherein the matrix comprises a ceramic including a material selected from the group consisting of silicon nitride, boron nitride, boron carbide, aluminum nitride, or combinations thereof.

15. The window of claim 11, wherein each of the plurality of ribs has a thickness of between 20 to 350 micrometers and a width of between 20 to 100 micrometers.

16. The window of claim 11, wherein a spacing between adjacent ribs is between 100 to 700 micrometers.

17. The window of claim 11, wherein:

a. the carbon composite material includes a stack of at least three carbon composite sheets;

b. openings between the plurality of ribs includes hexagonal-shaped openings; and c. carbon fibers in each of the stack of at least three carbon composite sheets are directionally aligned with a longitudinal axis of at least one of the plurality of ribs.

18. A window for allowing transmission of x-rays, comprising:

a. a support frame defining a perimeter and an aperture;

b. a plurality of ribs comprising a carbon composite material extending across the aperture of the support frame and carried by the support frame, the support frame and the plurality of ribs comprising a support structure;

c. wherein the carbon composite material comprises carbon fibers embedded in a matrix;

d. wherein the plurality of ribs form openings between the plurality of ribs;

e. a film disposed over, carried by, and spanning the plurality of ribs and disposed over and spanning the openings, and configured to pass radiation therethrough; and f. wherein the carbon composite material is made from at least one carbon composite sheet pressed or rolled together to form a carbon composite wafer and the carbon composite wafer is cut by a laser to form the plurality of ribs.

19. The window of claim 18, wherein at least 80% of the carbon fibers in the carbon composite material are directionally aligned with a longitudinal axis of the plurality of ribs across the aperture.

20. An x-ray detection unit comprising:

a mount;

the window of claim 18 hermetically sealed to the mount; and an x-ray detector attached to the mount, and wherein the window is configured to allow x-rays to impinge upon the x-ray detector.

21. A support structure, comprising:

a) a support frame defining a perimeter and an aperture;

b) a plurality of substantially straight and parallel ribs extending across the aperture of the support frame and carried by the support frame, and the plurality of ribs form openings between the plurality of ribs;

c) a plurality of intermediate support cross-braces:

i. extending between adjacent ribs of the plurality of ribs;

ii. spanning an opening between adjacent ribs without spanning the aperture of the support frame;

iii. including upper cross braces and lower cross braces, the upper cross braces being disposed in adjacent openings with respect to the lower cross braces, the upper cross braces and the lower cross braces being laterally off-set with respect to each other so that the plurality of intermediate support cross-braces are segmented and discontinuous with respect to one another; and iv. substantially perpendicular to the plurality of ribs;

d) wherein the plurality of ribs and the plurality of intermediate support cross-braces comprise a carbon composite material;

e) wherein the carbon composite material comprises carbon fibers:

v. embedded in a matrix;

vi. directionally aligned with the plurality of ribs;

vii. having a length that is at least as long as a rib in which it is comprised; and viii. having a diameter of at least 3 micrometers;

f) wherein the matrix comprises a material selected from the group consisting of polyimide, bismaleimide, and combinations thereof;

g) wherein each of the plurality of ribs has a thickness of between 20 to 350 micrometers; and h) wherein each of the plurality of ribs has a width of between 10 to 200 micrometers.

* * * * *